US006037011A

United States Patent [19]

Deegan et al.

[11] Patent Number: 6,037,011

[45] Date of Patent: Mar. 14, 2000

[54] HOT DIP COATING EMPLOYING A PLUG OF CHILLED COATING METAL

[75] Inventors: James J. Deegan, Flossmoor, Ill.; William A. Carter, Munster, Ind.; Howard L. Gerber, Lincolnwood, Ill.; Philip G. Martin, Gary, Ind.; Ismael G. Saucedo, Valparaiso, Ind.; Joseph W. Sliwa, Hammond, Ind.; Anatoly F. Kolesnichenko, Merrillville, Ind.

[73] Assignee: Inland Steel Company, Chicago, Ill.

[21] Appl. No.: 08/964,428

[22] Filed: Nov. 4, 1997

[51] Int. Cl.[7] ..... B05D 1/18; B05D 3/10

[52] U.S. Cl. ..... 427/433; 427/310; 427/431; 427/434.7; 427/436

[58] Field of Search ..... 427/310, 431, 427/433, 434.7, 436; 118/405; 164/461, 419

[56] References Cited

U.S. PATENT DOCUMENTS

| | | | |
|---|---|---|---|
| 2,394,545 | 2/1946 | Grupe | 427/433 |
| 3,060,056 | 10/1962 | Scott | 427/434.7 |
| 3,466,186 | 9/1969 | Carreker, Jr. | 427/431 |
| 3,610,204 | 10/1971 | Corrigan et al. | 118/405 |
| 4,169,426 | 10/1979 | Kornmann et al. | 118/67 |
| 4,953,487 | 9/1990 | Lewis | 118/629 |
| 5,000,369 | 3/1991 | Shotts et al. | 228/147 |
| 5,665,437 | 9/1997 | Frommann et al. | 427/591 |
| 5,736,199 | 4/1998 | Blucher | 427/430.1 |

FOREIGN PATENT DOCUMENTS

| | | |
|---|---|---|
| 42 08 578 A1 | 9/1993 | Germany . |
| 195 09 691 C1 | 5/1996 | Germany . |
| 3-79747 | 4/1991 | Japan . |

OTHER PUBLICATIONS

Saucedo et al., The Principle of 'Forbidden Zones' by MHD Containment of Liquid Metals, Conference Proceedings, Electromagnetic Processing of Materials, Paris, France, May 26–29, 1997, pp. 539–544.

*Primary Examiner*—Shrive Beck
*Assistant Examiner*—Michael Barr
*Attorney, Agent, or Firm*—Marshall, O'Toole, Gerstein, Murray & Borun

[57] ABSTRACT

A hot dip coating system comprises a bath of molten coating metal contained in a vessel having a strip passage opening located below the top surface of the bath. A metal strip is directed along a path extending through the strip passage opening and through the bath of molten coating metal, to coat the strip. A plug composed of solidified coating metal surrounds the strip downstream of the strip passage opening and is substantially stationary relative to the moving strip. The plug prevents escape of molten coating metal from the bath through the strip passage opening while permitting the strip to move along its path. Expedients are provided to chill the coating metal downstream of the strip passage opening to form and maintain the plug and to heat that part of the molten metal coating bath which is immediately downstream of the plug.

32 Claims, 17 Drawing Sheets

FIG. 10
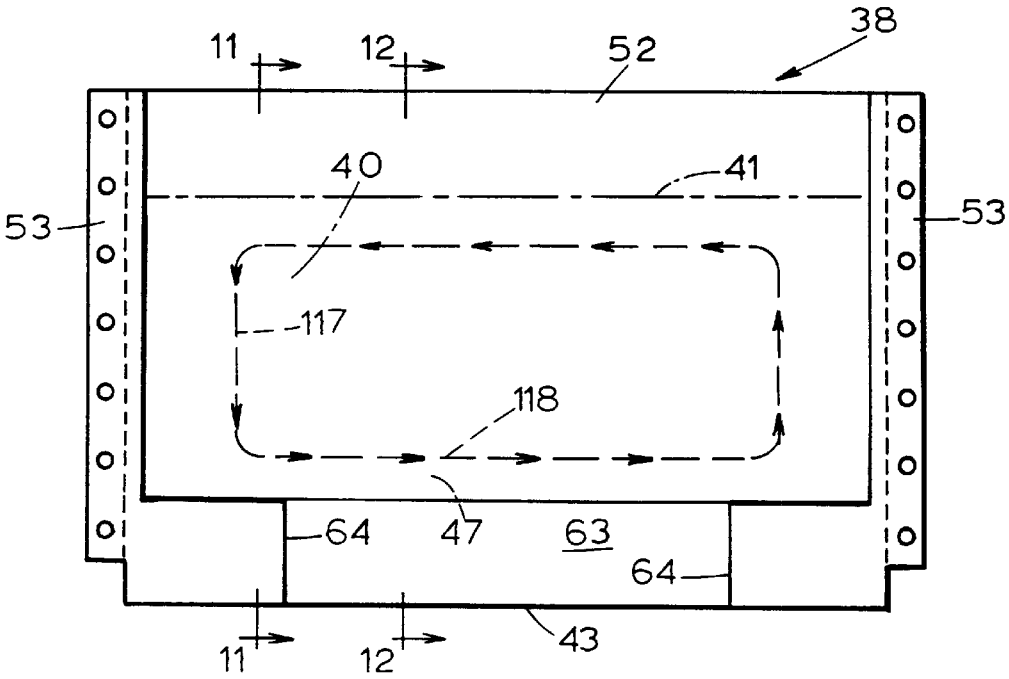
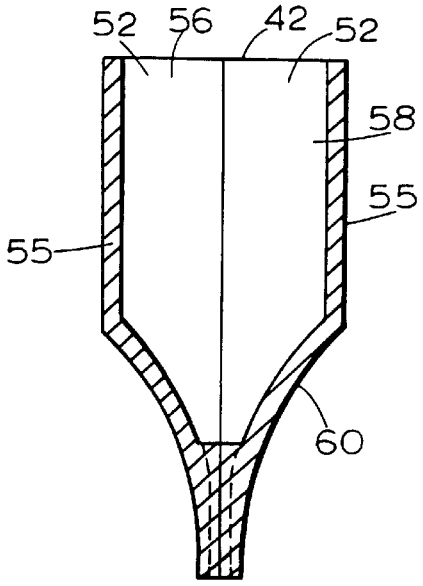
FIG. 11
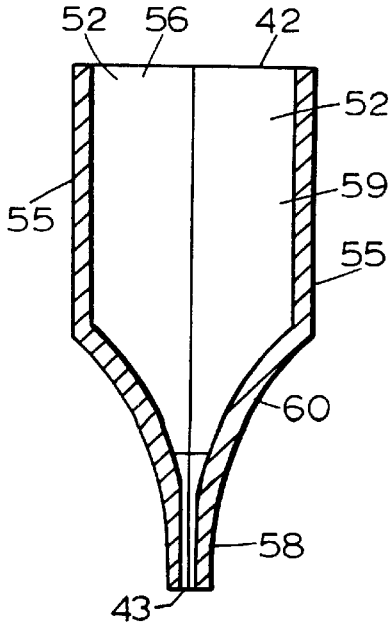
FIG. 12

FIG. 19
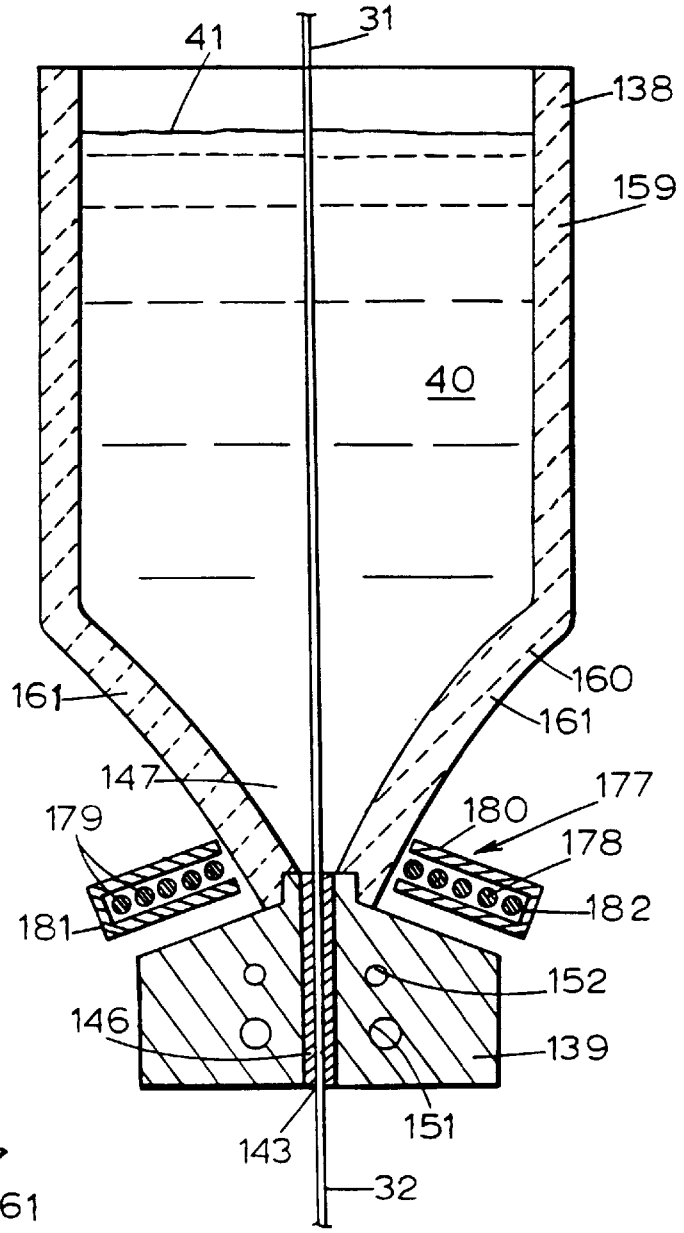
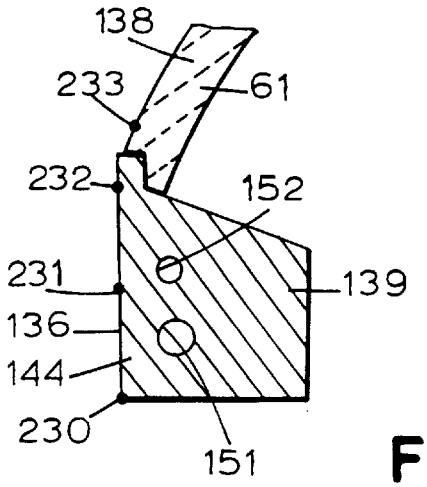
FIG. 27

FIG. 20
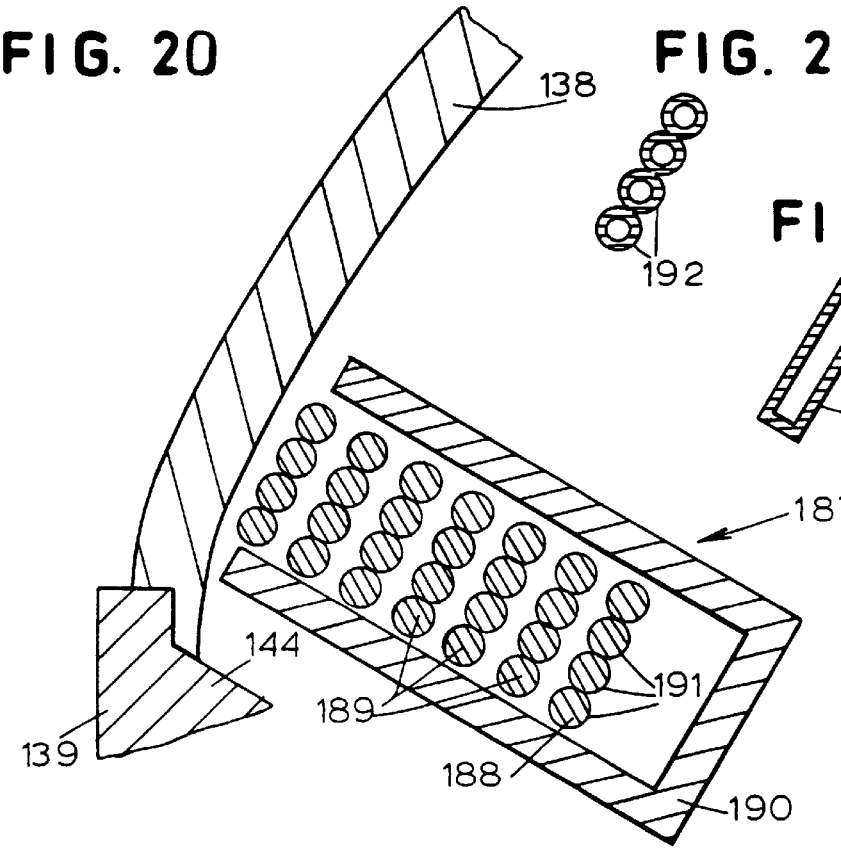
FIG. 20a
FIG. 20b
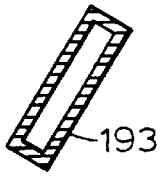
FIG. 21
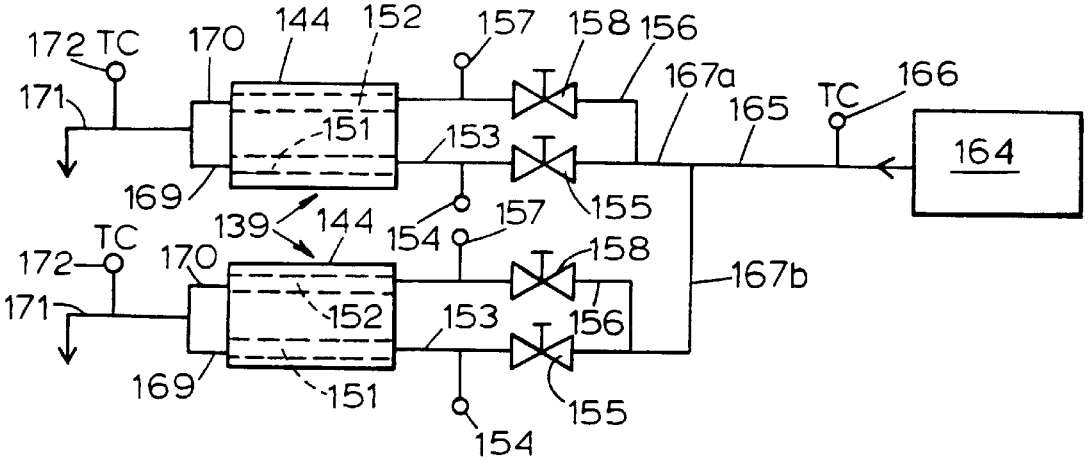

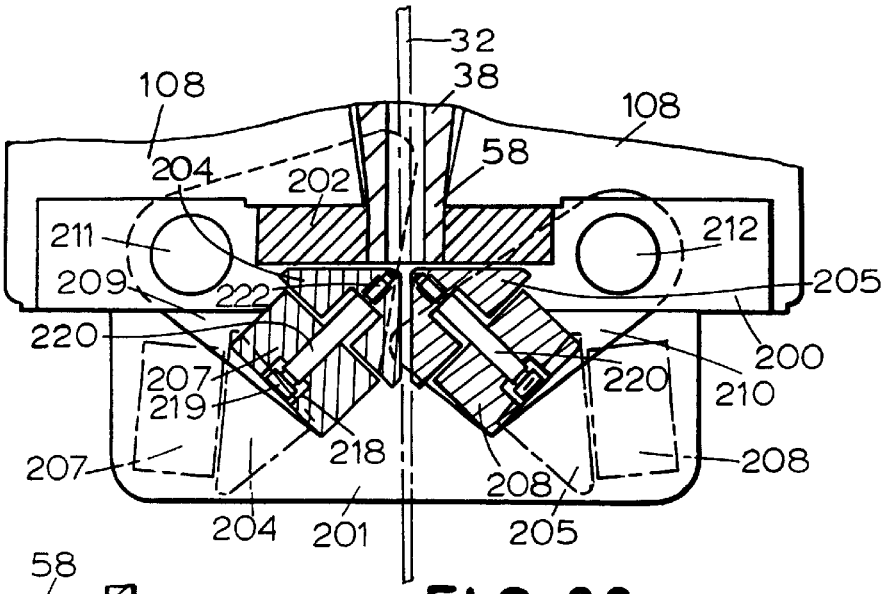
FIG. 22
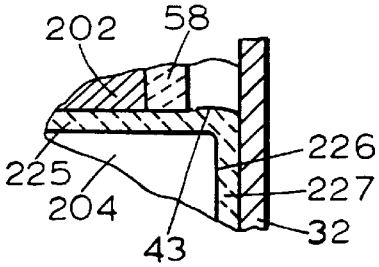
FIG. 24
FIG. 23
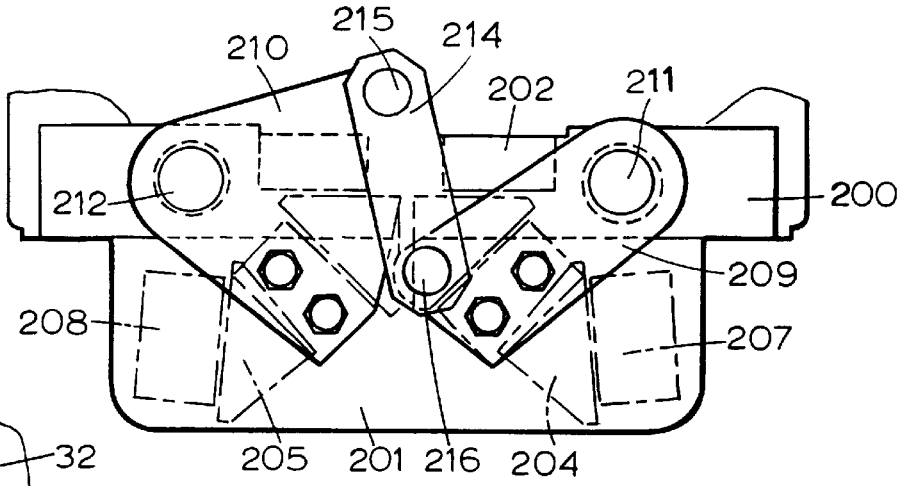
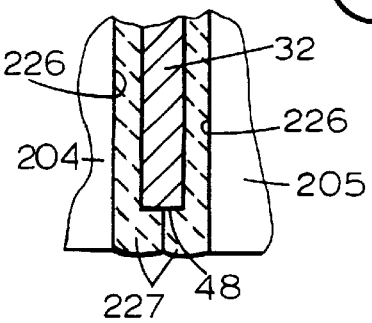
FIG. 25
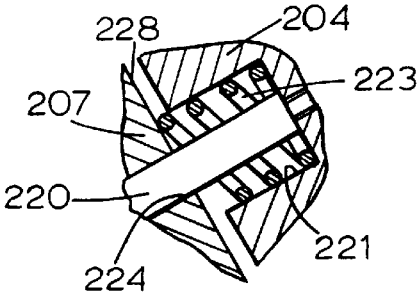
FIG. 26

HOT DIP COATING EMPLOYING A PLUG OF CHILLED COATING METAL

BACKGROUND OF THE INVENTION

The present invention relates generally to the hot dip coating of a metal strip, such as a steel strip, with a coating metal such as zinc or aluminum, or alloys of each, and more particularly to a hot dip coating procedure which dispenses with the need for one or more strip guide rolls submerged below the surface of a bath of molten coating metal.

Steel strip is coated with a coating metal, such as zinc or aluminum, to improve the resistance of the steel strip to corrosion or oxidation. One procedure for coating steel strip is to dip the steel strip in a bath of molten coating metal. The conventional hot dip procedure is continuous and usually requires, as a preliminary processing step, pre-treating the steel strip before the strip is coated with a coating metal. Pre-treatment improves the adherence of the coating to the steel strip, and the pre-treating step can be either (a) a preliminary heating operation in a controlled atmosphere or (b) a fluxing operation in which the strip surface is conditioned with an inorganic flux.

When the steel strip has been subjected to preliminary heating in a controlled atmosphere, the strip may enter the hot dip coating bath at an elevated temperature which, in the case of a molten coating bath composed of zinc or zinc alloys, for example, can be at the same temperature as the bath of molten coating metal (e.g., 450° C. (842° F.)). When the pre-treating step is a fluxing operation, the steel strip can enter the bath of molten coating metal at a temperature ranging from ambient temperature up to about 450° F. (232° C.), for example.

Whatever the pre-treating step, the conventional hot dip coating procedure employs a coating step performed in a bath of molten coating metal containing one or more submerged guide rolls for changing the direction of the steel strip or otherwise guiding the strip as it undergoes the hot dip coating step. More particularly, the steel strip normally enters the bath of molten coating metal from above and moves in a direction having a substantially downward component, then passes around one or more submerged guide rolls that change the direction of the steel strip from substantially downward to substantially upward, following which the strip is withdrawn from the bath of molten coating metal as the strip moves in the upward direction.

A number of problems arise from the employment of guide rolls submerged in the bath of molten coating metal. These problems are described in detail in application No. Ser. 08/822,782 entitled "Hot Dip Coating Method And Apparatus" U.S. Pat. No. 5,827,576, and the description therein is incorporated herein by reference.

Certain attempts have been made to eliminate the employment of submerged guide rolls in a hot dip coating procedure. In these attempts, the steel strip is introduced into the molten coating metal through a strip passage opening in the vessel which contains the bath; the opening is located below the surface of the bath, and the strip is directed through the opening and through the bath along a straight-line path, which may be either substantially vertical or substantially horizontal. Conducting a strip through the bath along a straight-line path eliminates the need for submerged guide rolls to change the direction of the strip as it passes through the bath.

The strip passage opening is typically located in the bottom of the vessel containing the bath, or in a side wall of the vessel below the surface of the bath, and expedients are employed to prevent the molten metal in the bath from escaping through the strip passage opening.

Some expedients employ mechanical seals at the opening. These mechanical seals engage the side surfaces of the strip as it moves downstream through the opening, causing the seal to wear or break which in turn causes leakage of molten coating metal through the opening. Other problems associated with mechanical seals include large thermal gradients in the coating metal bath between the location of the seal and downstream locations, freezing of the bath, quality problems with the strip coating and irregularities in the coating thickness on the strip.

Other expedients employ electromagnetic devices that are located adjacent the strip passage opening and that develop electromagnetic forces which urge the molten metal in the bath away from the opening. When one employs electromagnetic devices to contain the molten metal at the opening, wear is not a problem (as it is with mechanical seals). Some electromagnetic devices prevent the escape, from the molten metal bath, of the overwhelming majority of the molten metal in the bath (bulk containment), but there is still some leakage or dripping of molten metal from the bath through the strip passage opening, particularly along the edges of the opening. In some cases, bulk containment may approach 98% or more, but in all cases, leakage is at the very least a significant annoyance if not a major problem.

SUMMARY OF THE INVENTION

The present invention is directed to a hot dip coating procedure which (1) provides all the benefits accompanying the elimination of submerged guide rolls, (2) eliminates the need to employ mechanical seals, and, (3) not only obtains bulk containment of the molten coating metal in the bath, but also prevents leakage or dripping of molten coating metal through the strip passage opening. This is accomplished by forming a bath plug, composed of solidified coating metal from the bath. The plug extends downstream from the strip passage opening, surrounds the strip at a location immediately downstream of the opening, and is substantially stationary relative to the strip. The plug prevents the escape of molten metal from the bath through the opening while permitting the strip to move through the bath.

The relevant process comprises chilling the metal within the vessel, immediately downstream of the strip passage opening, to form the plug and to maintain the plug as the strip undergoes coating. The process further comprises heating the molten metal bath at a location downstream of the plug. A function of the heating step is to control the size (length) of the plug and to maintain a relatively stable bath temperature, among other things.

The vessel employed in the present invention has (i) a relatively narrow part extending downstream from the strip passage opening and (ii) a relatively wide part located downstream of the narrow part. The plug extends from the strip passage opening into the narrow part, and the heating step is performed immediately downstream of the plug.

Controls are exercised to control the chilling effect produced by the chilling step and to control the heating effect produced by the heating step so that the quantity of heat introduced into the bath by the heating step compensates for the quantity of heat removed from the bath by the chilling step. The chilling effect of the chilling step and the heating effect of the heating step are balanced to maintain the temperature of the bath relatively stable, which is important. The heating step also compensates for miscellaneous heat losses due to factors other than the chilling effect of the chilling step. Miscellaneous heat losses include heat losses from the molten metal bath to the walls of the vessel containing the bath and to the atmosphere. When the vessel is composed of refractory material, miscellaneous heat losses may be so insubstantial that they can be ignored.

In one embodiment, the chilling step employs, as the chilling medium, the strip and the movement of the strip through the bath. The chilling effect is influenced by the speed at which the strip moves through the bath, and by the temperature of the strip. The desired chilling effect is accomplished by providing the strip with a temperature substantially below the melting point of the coating metal as the strip enters the strip passage opening. Preferably, the chilling effect is controlled by controlling the temperature of the strip as it enters the strip passage opening, while maintaining the strip speed substantially unchanged.

In another embodiment, the chilling step employs, as the chilling medium, a chilling element located immediately downstream of the strip passage opening. In this embodiment, the strip moves through a passageway in the chilling element that is, in effect, an upstream extension of the vessel containing the molten coating bath, and the strip passage opening to the bath is at the upstream end of the passageway in the chilling element. The chilling element is provided with a plurality of cooling channels through which a cooling fluid may be circulated. A cooling fluid is circulated through the chilling element, and the chilling effect produced by the chilling element is controlled by controlling the number of cooling channels through which the cooling fluid is circulated.

There are a number of embodiments of the heating step employed in the present invention. One such embodiment employs an electromagnet to generate a magnetic field that extends across the coating bath immediately downstream of the plug; this embodiment not only heats the bath, but also, (a) provides a magnetic levitation effect which assists in the bulk containment of the bath and (b) stirs the bath, which can be beneficial. Another embodiment of the heating step employs induction heating at a location immediately downstream of the plug. A third embodiment employs resistance heating elements to provide conduction heating at a location immediately downstream of the plug.

Other features and advantages are inherent in the method and equipment claimed and disclosed or will become apparent to those skilled in the art from the following detailed description in conjunction with the accompanying diagrammatic drawings.

BRIEF DESCRIPTION OF THE DRAWINGS

FIG. 10 is a side elevational view of a separable one-half of the vessel of FIGS. 8–9, showing the interior of the vessel;

FIG. 11 is a vertical sectional view of the vessel taken along line 11—11 in FIG. 10, but showing the two halves of the vessel joined together;

FIG. 12 is a vertical sectional view similar to FIG. 11 and taken along line 12—12 of FIG. 10;

FIG. 19 is a vertical sectional view, like FIG. 18, showing still another variation of the equipment shown in FIGS. 4–5;

FIG. 20 is an enlarged, fragmentary, vertical sectional view, showing a further variation of the equipment shown in FIGS. 4–5;

FIGS. 20*a* and 20*b* are fragmentary, vertical sectional views showing alternative arrangements for one part of the equipment variation shown in FIG. 20;

FIG. 21 is a flow diagram illustrating a fluid cooling arrangement for the chill element used in the embodiment of FIGS. 3–5;

FIG. 22 is a fragmentary, elevational view, partially in section, showing a mechanical gate or bottom seal for use with a system of the present FIG. 23 is a fragmentary end view, looking in a direction opposite that of FIG. 22, and showing the gate of FIG. 22;

FIG. 24 is an enlarged, fragmentary, vertical, sectional view showing a part of the gate;

FIG. 25 is an enlarged, fragmentary, horizontal sectional view of a part of the gate;

FIG. 26 is an enlarged, fragmentary, vertical sectional view of another part of the gate;

FIG. 27 (sheet 14) is a fragmentary, vertical, sectional view, similar to FIG. 5.

DETAILED DESCRIPTION

Figure 1:
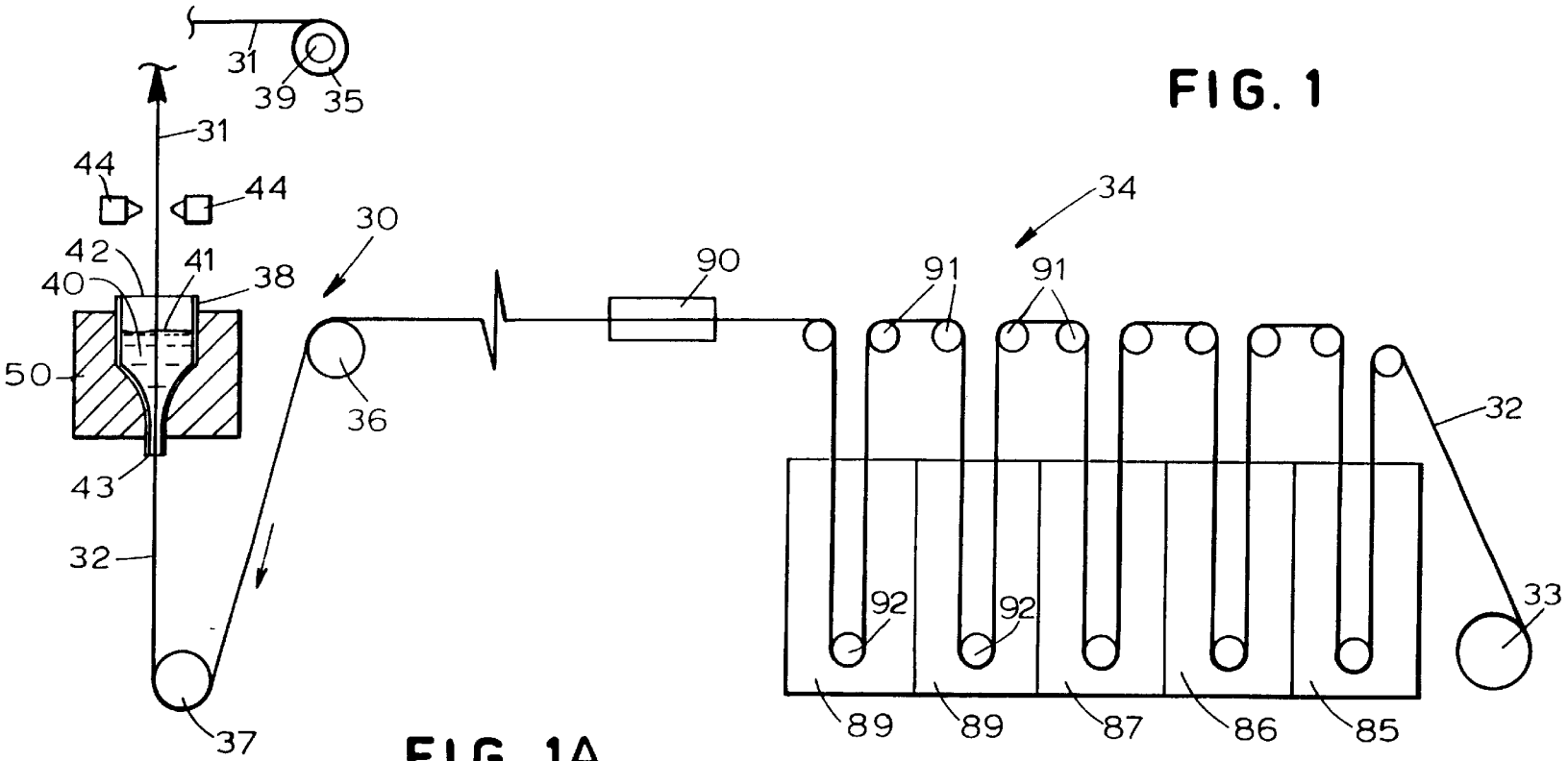
FIG. 1 is a schematic diagram of a hot dip coating system in accordance with one embodiment of the present invention.

Referring initially to FIG. 1, illustrated generally at 30 is an embodiment of a hot dip coating system in accordance with the present invention. System 30 in FIG. 1 is intended for use in the coating of a continuous strip of metal, such as steel, with a coating metal composed of zinc or zinc alloy.

Other embodiments of hot dip coating systems in accordance with the present invention may be employed to coat a continuous metal strip with other coating metals such as aluminum, aluminum alloys or the like. Tin, lead and alloys of each are typical examples of still other coating metals which may be applied in hot dip coating systems in accordance with other embodiments of the present invention.

Figure 2:
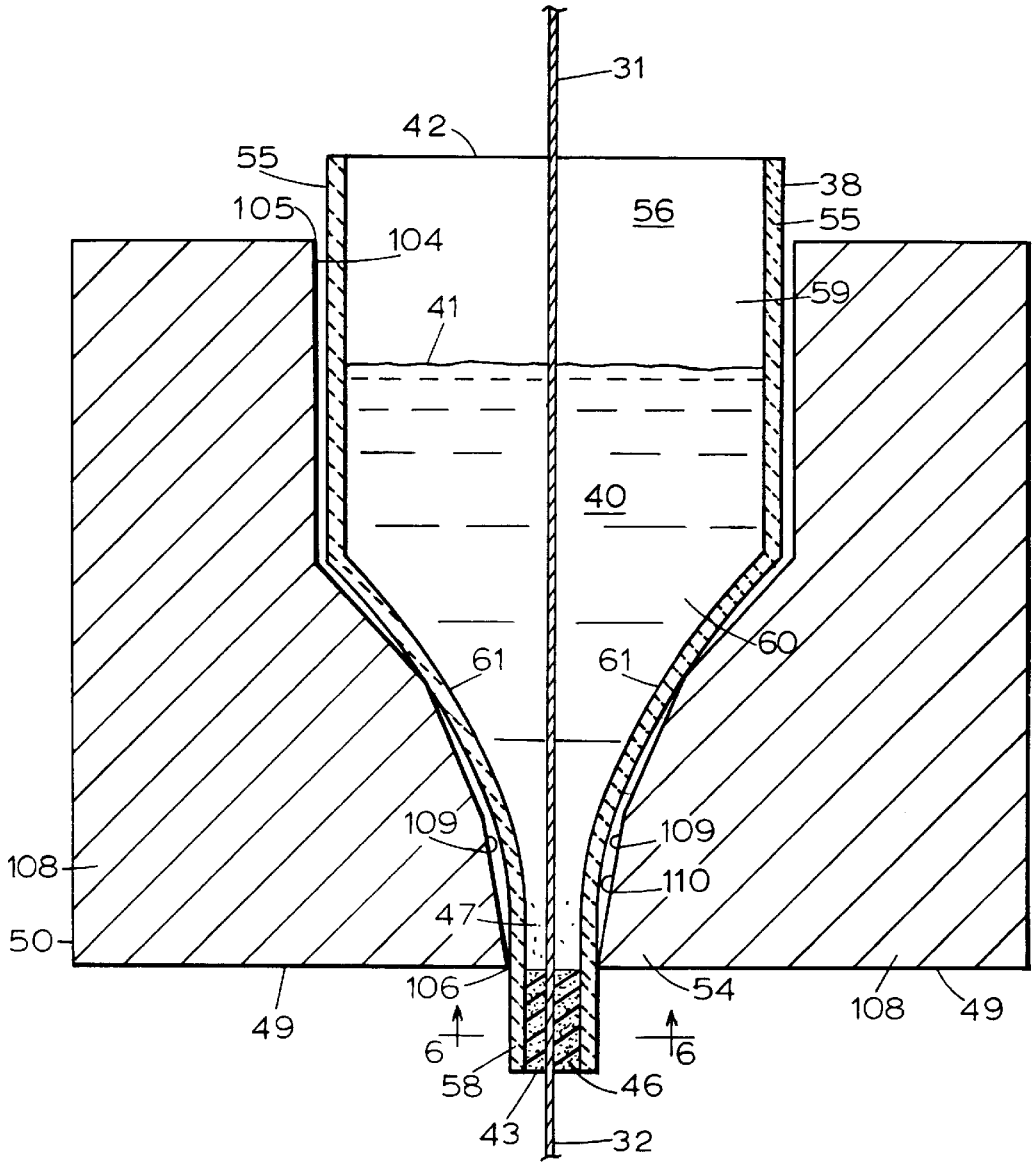
FIG. 2 is an enlarged vertical sectional view of a portion of the system of FIG. 1.

Referring now to FIGS. 1 and 2, a continuous steel strip 32 is unwound from a coil 33 and subjected to a pre-treatment operation in a pre-treatment apparatus indicated generally at 34. The pre-treatment, in this case, includes the application to strip 32 of a flux for facilitating the hot dip coating of zinc onto steel strip 32. This pre-treatment will be discussed in more detail later. After pre-treatment, strip 32 is directed by guide rolls 36, 37 along a path which extends through a strip passage opening 43 in the bottom of a vessel 38 containing a bath 40 of molten coating metal, in this case, zinc. Bath 40 has a top surface 41, and strip passage opening 43 is located below top surface 41 of bath 40. Opening 43 enables the introduction of strip 32 into bath 40, and the strip then moves along a path which extends through bath 40. Movement of strip 32 through bath 40 coats strip 32 with a layer of the coating metal of which bath 40 is composed, and a coated strip 31 exits from bath 40 downstream of bath top surface 41.

Vessel 38 has an open upper end 42 through which coated metal strip 31 moves upwardly after passing through bath 40. Located above vessel 38 is a pair of so-called air knives 44, 44 (FIG. 1) of a type conventionally used to control the thickness of the coating on strip 31, e.g., by directing jets of heated or unheated air or nitrogen against strip 31. Located downstream of air knives 44, 44 is a take-up reel 39 onto which coated strip 31 is rewound into a coil 35 which is removable from reel 39.

Figure 6:
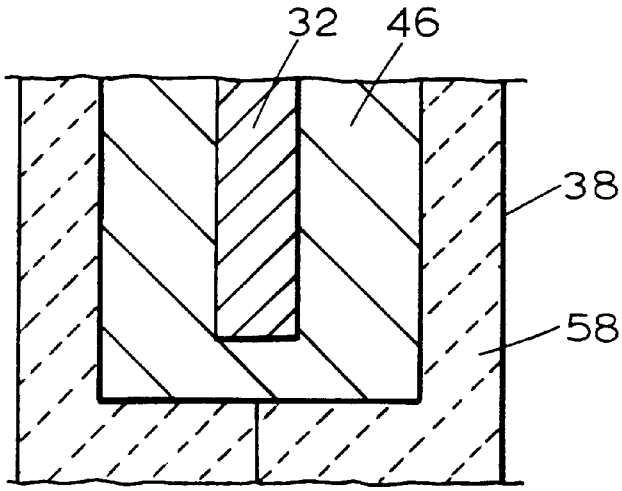
FIG. 6 is a fragmentary, horizontal sectional view taken along line 6—6 in FIG. 2.
Figure 7:
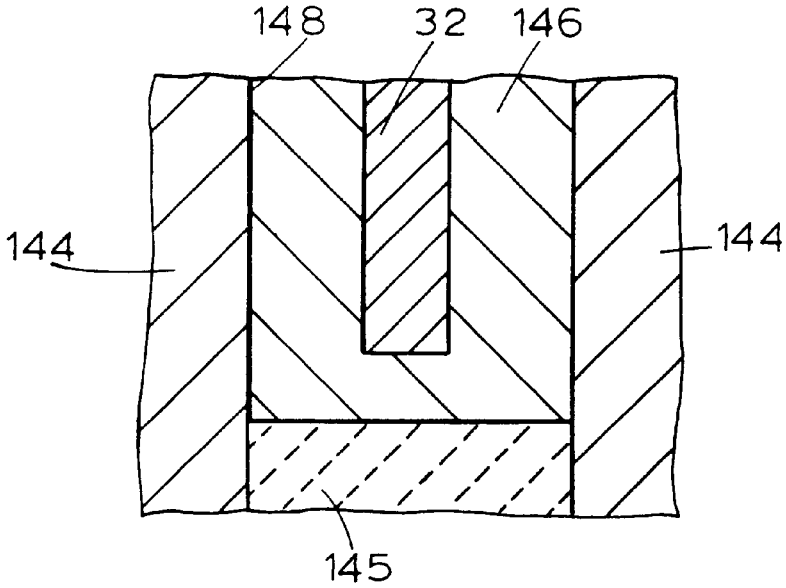
FIG. 7 is a fragmentary, horizontal sectional view taken along line 7—7 in FIG. 5.

An important part of hot dip coating system 30 is a plug 46 (FIG. 2), composed of solidified coating metal from bath 40 and surrounding strip 32 at a location immediately downstream of vessel opening 43 (FIGS. 2 and 6). Plug 46 fills the space between strip 32 and a narrow, vertically disposed, neck-like, upstream part 58 of vessel 38. Plug 46 is substantially stationary relative to moving strip 32. Plug 46 comprises structure for preventing the escape of molten metal from bath 40 through opening 43 while permitting strip 32 to move through bath 40. An additional expedient, in the form of a mechanical gate or seal, is employed at the very beginning of a hot dip coating operation to prevent the escape of molten metal from bath 40; this will be described later.

System 30 includes expedients for chilling the metal within vessel 38 downstream of opening 43 to form plug 46 and to maintain the plug as strip 32 undergoes coating. System 30 also includes an expedient for heating molten metal bath 40 at a location 47 immediately downstream of plug 46. The purpose of the heating step will be described later.

In the embodiment illustrated in FIG. 2, the molten metal bath is heated at bath location 47 by an electromagnet 50 employing a time-varying current (AC or pulsating DC) for generating a magnetic field which extends across bath 40 at location 47, which is immediately downstream of plug 46. The flux density of the magnetic field generated by magnet 50 is at a maximum at bath location 47 because the gap 110 between pole faces 109, 109 of magnet 50 is narrowest there. The magnetic field also extends across the gap between pole faces 109, 109 at locations above (i.e., downstream of) bath location 47, but the flux density is lower at the downstream locations because the gap is wider there; as the width of the gap increases, the flux density decreases. The magnetic field also extends below (i.e. upstream of) the bottom 49 of magnet 50, to heat at least the upper part of plug 46.

In addition to the heating expedient illustrated in FIG. 2, there are other embodiments of expedients for heating the molten metal bath at location 47, in system 30; these other expedients will be described later in connection with the system illustrated in FIGS. 3–5.

As noted above, in a hot dip coating system, such as that depicted in FIG. 1, the strip is subjected to a pre-treatment operation at 34 in which a flux is applied to the strip. When subjected to that kind of pre-treatment, strip 32 enters bath 40 at a relatively cool temperature substantially below the temperature of the molten metal coating bath. Under those circumstances, the chilling step which forms plug 46 employs relatively cool strip 32 and the movement of cool strip 32 through bath 40 to provide the chilling effect. The chilling effect produced by the movement of strip 32 through bath 40 is influenced by the speed at which strip 32 moves through bath 40 and by the temperature of the strip. The desired chilling effect is accomplished by providing strip 32 at a temperature substantially below the melting point of the coating metal in bath 40 at the time strip 32 enters strip passage opening 43 in vessel 38. For reasons discussed later, the chilling effect is preferably controlled by controlling the temperature of strip 32 as it enters strip passage opening 43, while maintaining the strip speed substantially unchanged.

The chilling effect produced by strip 32 not only forms and maintains plug 46, but also, it cools bath 40. It is desireable to maintain bath 40 within a pre-selected temperature range above the melting point of the coating metal. When bath 40 is composed of zinc (melting point 420° C. (788° F.), the bath is maintained at a temperature up to about 500° C. (932° F.), e.g., a temperature in the range 435–470° C. (815–878° F.). The heat loss in bath 40 produced by strip 32 can be offset in whole or in part by employing various heating expedients downstream of plug 46.

In one embodiment of the present invention, the heat loss in bath 40, due to the chilling effect of strip 32, is reduced by heating strip 32 after flux has been applied to the strip and before the strip enters strip passage opening 43. When doing so, care must be taken not to overheat strip 32. The strip must still be at a temperature cool enough to form and maintain plug 46; in addition the strip must be at a temperature which will not interfere with the function the flux is to perform when the flux-coated strip enters bath 40.

More particularly, the function of the flux is to remove iron oxide from the surface of the steel strip when the strip enters the molten metal bath, leaving a cleaned surface on the strip, to which the coating metal will better adhere. A mechanism involved in the cleaning operation is the dissociation of the flux, at the temperature of the molten coating bath, to produce a compound which performs the cleaning function. At the temperature of the molten coating bath, dissociation of the flux is complete during the relatively brief time the moving strip spends in the bath. At lower temperatures, dissociation requires a longer time at temperature. When dissociation occurs outside the bath, the flux is wholly or partially ineffective. Therefore, if the strip is heated, before entering the bath, to reduce loss of heat by the bath due to the chilling effect of the strip, one must avoid a strip temperature at which the flux will dissociate over the period of time preceding entry of the strip into the bath. For a given flux, the time during which the flux will remain stable at a given temperature (i.e., the time before the flux dissociates) is information available from commercial suppliers of flux.

Heating the strip to reduce heat loss by the bath is easier than heating the bath to compensate for heat loss caused by an unheated (or lesser heated) strip. In summary, it is desireable to heat the strip, after flux has been applied, to a relatively high temperature, so long as that temperature (a) permits the chilling effect required to form and maintain the plug and (b) avoids dissociation of the flux during the time preceding entry of the strip into the bath.

The expedient utilized to adjust the temperature of strip 32 when it undergoes a pre-treatment involving the application of flux, in accordance with the embodiment of FIG. 1, will be discussed later.

Figure 1A:
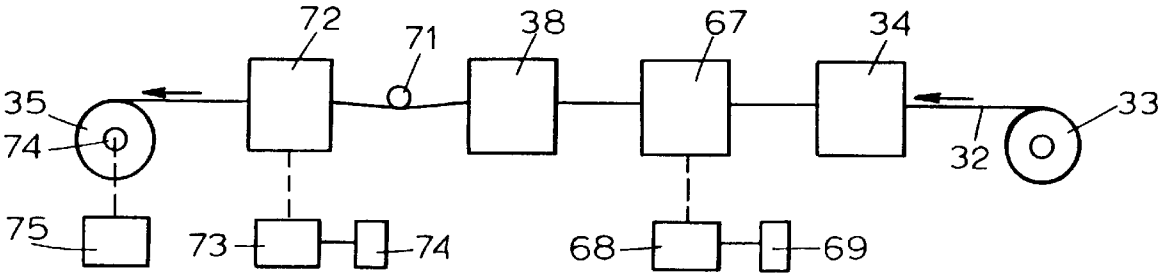
FIG. 1*a* is a block diagram illustrating speed and tension controls for the strip coated by the system.

As previously noted, the chilling effect can also be influenced by the speed with which strip 32 moves through bath 40. Increasing strip speed increases its chilling effect at a given strip temperature, and decreasing strip speed decreases its chilling effect. The mechanism for controlling the speed of strip 32 will now be described, with reference to FIG. 1*a*.

Strip 32 is unwound from coil 33 by a bridle 67 located between pre-treatment apparatus 34 and vessel 38. Coil 33 is mounted on a pay-off reel 68 which may be associated with a brake or with a drive motor which acts as a drive or a brake for the reel. Bridle 67 is rotated by a motor 68, the speed of which is controlled by a speed control device 69. Bridle 67 tensions strip 32. The speed of strip 32 is controlled by bridle 67, motor 68 and speed control device 69. Located downstream of vessel 38 is a so-called dancer roll 71 and a second bridle 72 rotated by a motor 73, the speed of which is adjusted by a speed control device 74. Dancer roll 71 and second bridle 72 cooperate to maintain tension in strip 32 downstream of vessel 38.

As previously noted, coil 35, composed of coated strip, is rotatably mounted on a take-up reel 39. Reel 39 is driven by a motor 75, and motor 75 and reel 39 pull, through the medium of strip 32, against second bridle 72. Dancer roll 71 bears against strip 32 from above and is weighted to form a pocket in the strip. The vertical position of dancer roll 71 is sensed and is employed to control the speed of second bridle 72, for maintaining the appropriate tension in strip 32, downstream of vessel 38. The above-described equipment for controlling the speed and tension of strip 32 is conventional and is known to those skilled in the art of operating continuous hot dip coating systems (or other continuous strip-treating systems).

As noted above, the speed of strip 32 is determined by the speed of bridle 67 and motor 68, and the speed of these is controlled by speed control device 67. Device 67 can be manually or automatically operated in response to the temperature sensed in bath 40, e.g. at location 47 (FIG. 2), or in response to a combination of (a) the temperature sensed in bath 40 and (b) the temperature of strip 32 as it enters vessel 38 through strip passage opening 43. The relevant temperatures can be sensed by employing conventional temperature sensing devices to measure the temperature at bath location 47 (and/or elsewhere in bath 40) and to measure the temperature of strip 32 below bottom opening 43 of vessel 38, for example.

Figure 3:
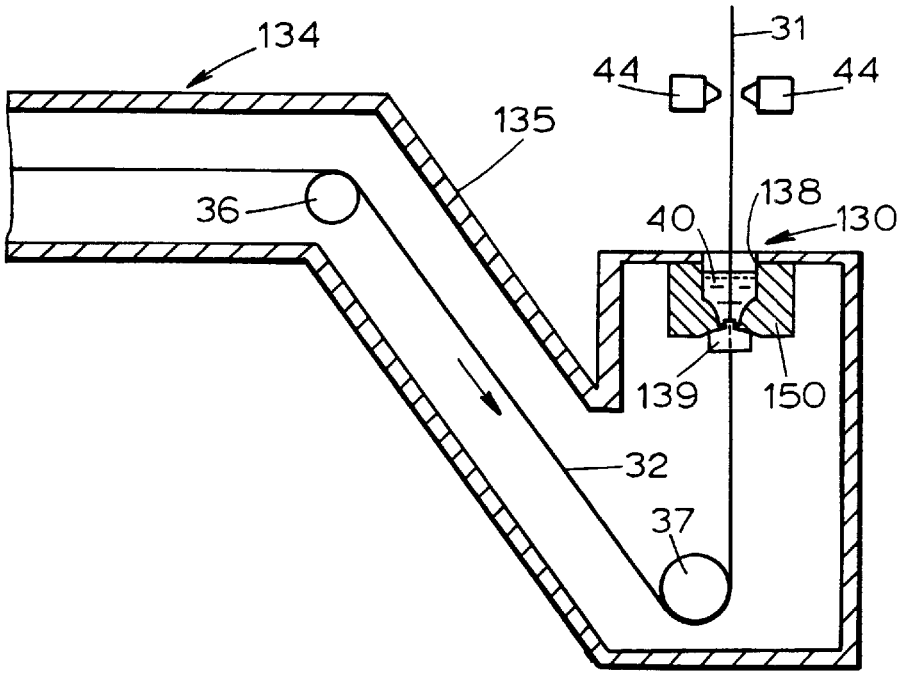
FIG. 3 is a fragmentary representational view, partially in section, of a hot dip coating system in accordance with another embodiment of the present invention.

Although adjusting the speed of strip 32 can change the chilling effect produced by the strip, changes in strip speed can have undesireable side effects; these include subjecting strip 32 to uneven heat treatment upstream of bath 40 (when the system of FIG. 3 is employed) and producing uneven coating weights, along the length of the strip. The preferred procedure for controlling the chilling effect of strip 32 is to select a desired strip speed for reasons other than the strip's chilling effect and then adjust the chilling effect by adjusting the temperature of the strip, while maintaining the speed of strip 32 substantially unchanged. Strip temperature is adjusted upstream of vessel 38, employing conventional strip heating and/or cooling apparatuses.

As previously noted, bath location 47 is located immediately downstream of plug 46, and a heating effect is produced there by electromagnet 50, or by some other heating expedient to be described later. In accordance with the present invention, the heating effect produced at bath location 47 is controlled so that the quantity of heat introduced into the bath by the heating step compensates for the quantity of heat removed from the bath by the chilling step which, in the particular embodiment now being described, is controlled by controlling the temperature of strip 32 while maintaining strip speed substantially unchanged. To the extent necessary, the heating step also compensates for miscellaneous heat losses from the bath. In all embodiments of the present invention, miscellaneous heat losses are relatively insubstantial (if not negligible) compared to the quantity of heat removed from the bath by the chilling effect.

The chilling effect of the chilling step and the heating effect of the heating step are balanced to maintain the temperature of bath 40 relatively stable. When the molten metal coating bath is composed of zinc, it is desirable to maintain the bath at a temperature above 420° C. (788° F.) (the melting point of zinc) up to about 500° C. (932° F.), e.g., a temperature in the range 435–470° C. (815–878° F.). Maintaining the bath at a relatively stable temperature, such as a temperature within the ranges described in the preceding sentence (when the bath is zinc), maintains plug 46 in a solid state and allows one to control the size of the plug and prevent excessive plug growth; this will be discussed in more detail later.

The heating effect produced at bath location 47, which is immediately downstream of plug 46, can be controlled by adjusting the strength of the magnetic field generated there by electromagnet 50. The strength of the magnetic field can, in turn, be controlled by adjusting the current which flows through the coils associated with electromagnetic 50; these coils will be described in more detail later in connection with a detailed description of electromagnet 50.

In the embodiment of FIGS. 1–2, bath 40 may be composed of an alloy consisting essentially of zinc with a small amount (e.g. 0.2%) of aluminum. A bath composed of this alloy has a melting point a little under 420° C. (788° F.). Plug 46 has a temperature which is below the melting point of bath 40 and above the temperature (e.g., 40° C. (104° F.)) at which strip 32 enters vessel 38 through strip passage opening 43. Plug 46 prevents the escape of molten coating metal from vessel 38 through strip passage opening 43. In the embodiment of FIGS. 1–2, if strip 32 enters strip passage opening 43 at a temperature of about 120° C. (248° F.) or above, it may be difficult to maintain plug 46 in a state in which the plug prevents leakage from bath 40.

Unless otherwise indicated, the bath and strip temperatures discussed herein are in the context of bath 40 being composed of unalloyed zinc or the zinc alloy described in the preceding paragraph.

Plug 46 exerts drag or friction on strip 32 as the strip moves through the plug, and the drag or friction exerted by plug 46 can be reduced by decreasing the length of plug 46 (i.e. decreasing the vertical dimension of plug 46 in FIG. 2).

The length of the plug can be determined by measuring the temperature of the plug at a location near the downstream end of the plug. The cooler the temperature of the plug at a given downstream plug location, the longer the plug. This will be discussed in more detail subsequently.

The length of the plug, and the drag or friction exerted by the plug, can be decreased by reducing the chilling effect produced by strip 32 which in turn requires either reducing the speed of strip 32 or increasing the temperature of strip 32 as it enters strip passage opening 43, or a combination of the two. The length of plug 46 may also be decreased by increasing the heating effect produced by electromagnet 50 at bath location 47 which in turn is increased by increasing the electric current employed to energize electromagnet 50. Appropriate combinations of (a) strip speed, (b) strip temperature and (c) the heating effect produced by electromagnet 50, to decrease the length of plug 46 or to increase its length, can be determined empirically; preferably, strip speed is maintained substantially unchanged and adjustments are made to (b) or (c) or both.

Vessel 38 will now be described in more detail with reference to FIGS. 2 and 8–12.

As seen in FIG. 2, vessel 38 has a substantially funnel-shaped, vertical cross-section taken along a vertical plane perpendicular to the plane of strip 32. Also as shown in FIG. 2, vessel 38 has (i) a relatively narrow part 58 extending downstream from opening 43 and (ii) a relatively wide part 59 located downstream of the narrow part. Plug 46 extends from opening 43 into narrow part 58.

Figure 8:
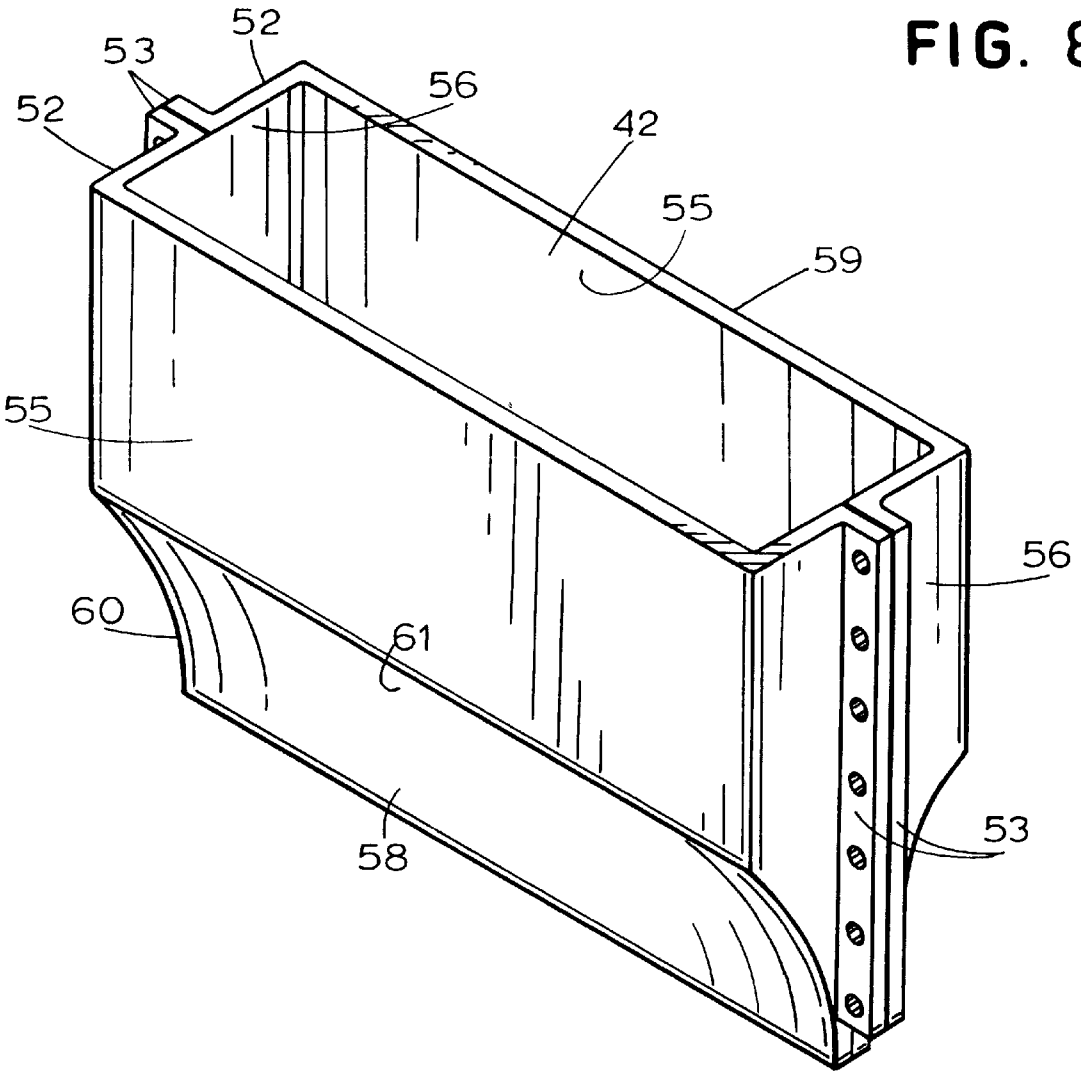
FIG. 8 is a perspective of a vessel for holding a bath of molten coating metal, for use in a system in accordance with the present invention.
Figure 9:
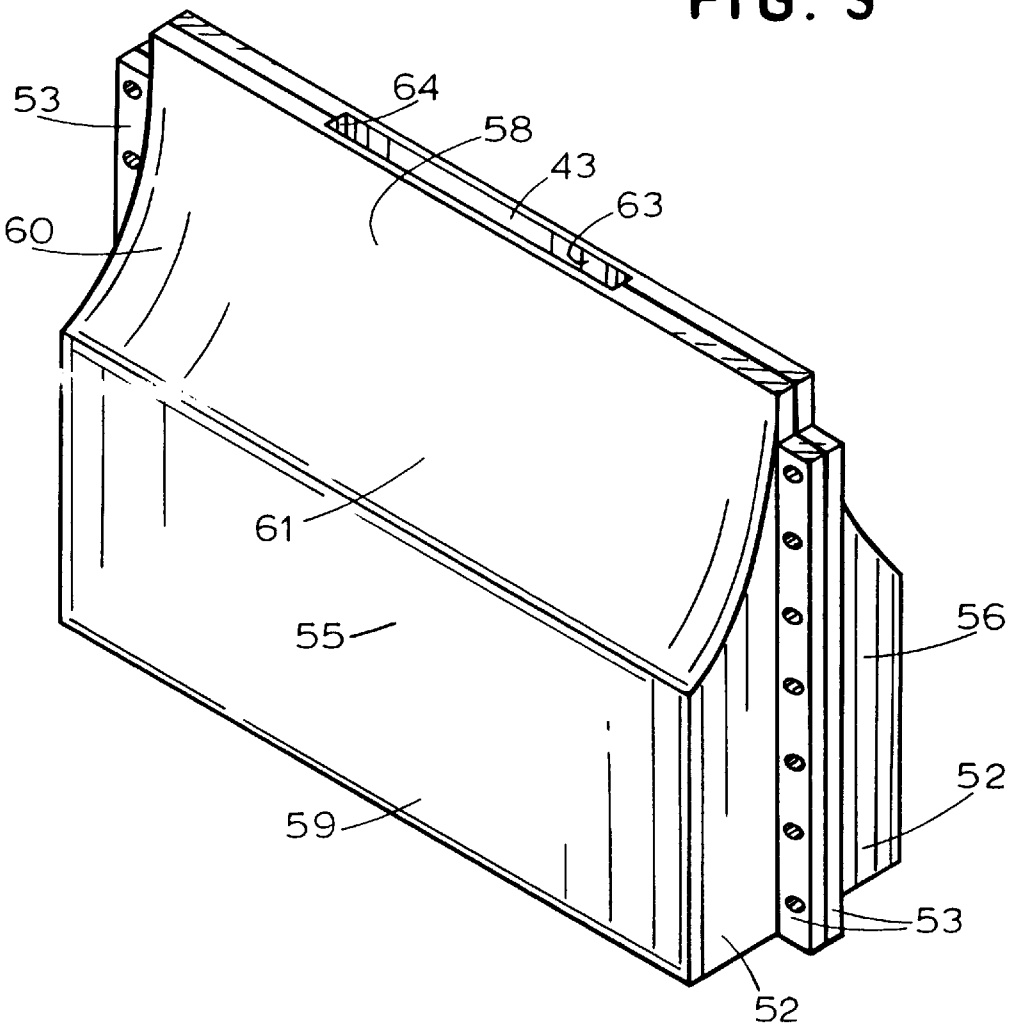
FIG. 9 is a perspective of the vessel of FIG. 8, in an inverted position.

Referring now to FIGS. 8–12, vessel 38 is composed of two half-vessels 52, 52 joined together at opposite ends along vertical flanges 53, 53. When the two vessel halves are joined together, they define an elongated, trough-shaped vessel 38 having an open upper end 42 and a slot-like, strip passage opening 43 located at the bottom of the vessel (FIG. 9).

Vessel 38 has a pair of longitudinal sidewalls 55, 55 and a pair of end walls 56, 56 each extending between the ends of sidewalls 55, 55. Sidewalls 55, 55 define the funnel-shaped, vertical cross section shown in FIGS. 2 and 11–12. Vessel 38 and its funnel-shaped cross section include the aforementioned relatively narrow lower part 58 and relatively,wide upper part 59. An intermediate vessel part 60 is located between wide upper part 59 and narrow lower part 58 and comprises a pair of sidewall portions 61, 61 converging in an upstream direction from wide upper part 59 toward narrow lower part 58.

The materials from which vessel 38 can be constructed include non-magnetic stainless steel and refractory materials.

Referring now to FIG. 10 which illustrates the interior of vessel 38, strip passage opening 43 is defined by a pair of sides 63, 63 (only one of which is shown in FIG. 10) and a pair of ends 64, 64.

Referring again to pre-treatment apparatus 34 (FIG. 1), this apparatus may be of the type conventionally employed to apply flux to a continuous steel strip 32 prior to hot dip coating the strip with zinc. More particularly, apparatus 34 comprises an alkali cleaning section 85 followed by a rinsing section 86 in turn followed by an acid pickling section 87, followed by a rinsing section 88, followed by a section 89 in which flux is applied, after which the strip is passed through a drying section 90 employing induction heating or hot forced air heating, for example. The strip is directed through apparatus 34 by upper and lower guide rolls 91, 92 respectively.

Heating at section 90 is employed to dry the flux on the strip and, optionally, to warm the strip. Heating at section 90 is controlled, in one series of examples, so that the temperature of strip 32 as it enters strip passage opening 43 in vessel 38 is substantially below the melting point of the molten coating metal in bath 40. In one example, strip 32 enters strip passage opening 43 at a temperature of about 100° F. (38° C.), although higher temperatures may be employed. As previously noted, in the embodiment depicted in FIGS. 1–2, strip 32 should be maintained at a temperature below about 120° C. (248° F.) in order to maintain plug 46 in a state in which the plug prevents leakage of molten coating metal from bath 40 through opening 43. When one employs a strip temperature below about 120° C., there are no dissociation problems with fluxes conventionally employed for coating steel strip with zinc, when employing the coating method of FIG. 1.

If necessary, a cooling stage employing conventional cooling expedients may be located upstream of strip passage opening 43 and downstream of apparatus 34 to ensure that strip 32 enters opening 43 at a temperate sufficiently low to provide the desired chilling effect. In one embodiment, there is associated with system 30, upstream of strip passage opening 43, both a heating stage and a cooling stage, each employed, as necessary, to ensure that strip 32 enters strip passage opening 43 at the desired temperature. The heating stage employs the heat produced at drying section 90 of pre-treatment apparatus 34, and if necessary, also employs a supplemental heating section (e.g., an induction heater) downstream of drying section 90.

Electromagnet 50 will now be described in greater detail, with reference to FIGS. 2 and 13–16.

Electromagnet 50 comprises a rectangular outer member 100 composed of magnetic material and comprising a pair of opposed, facing longitudinal sidewalls 101, 101, each having a pair of opposite ends, and a pair of end walls 102, 102 each extending between corresponding ends of sidewalls 101, 101. Sidewalls 101, 101 together with end walls 102, 102 define a vertically disposed inner space 104, having open upper and lower ends 105, 106 respectively.

Figure 14:
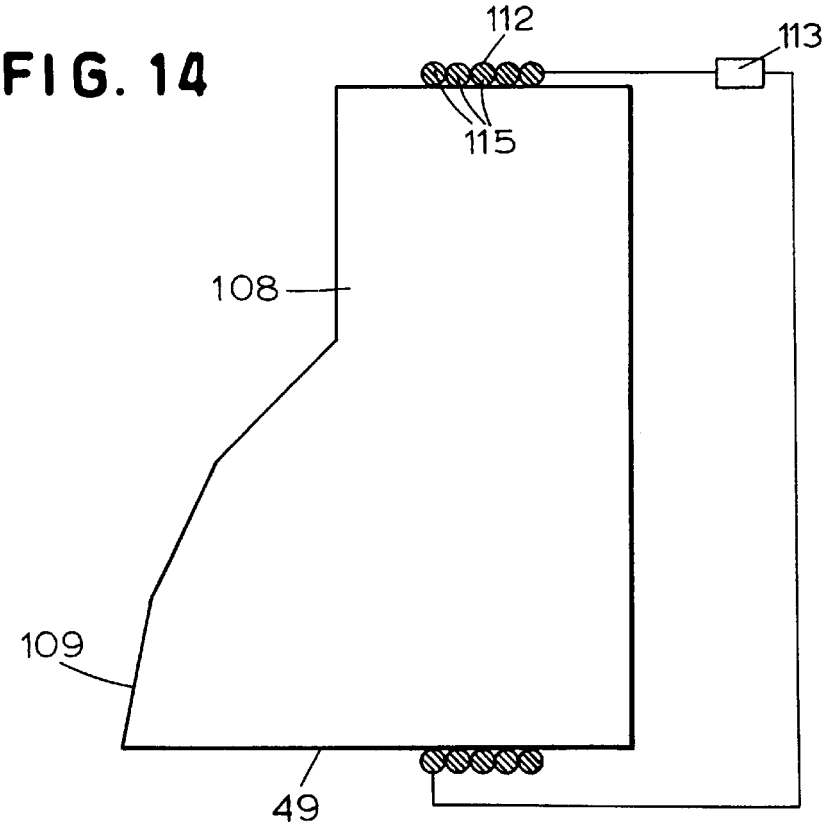
FIG. 14 is an end view, partially in section, of a portion of the electromagnet of FIG. 13.
Figure 16:
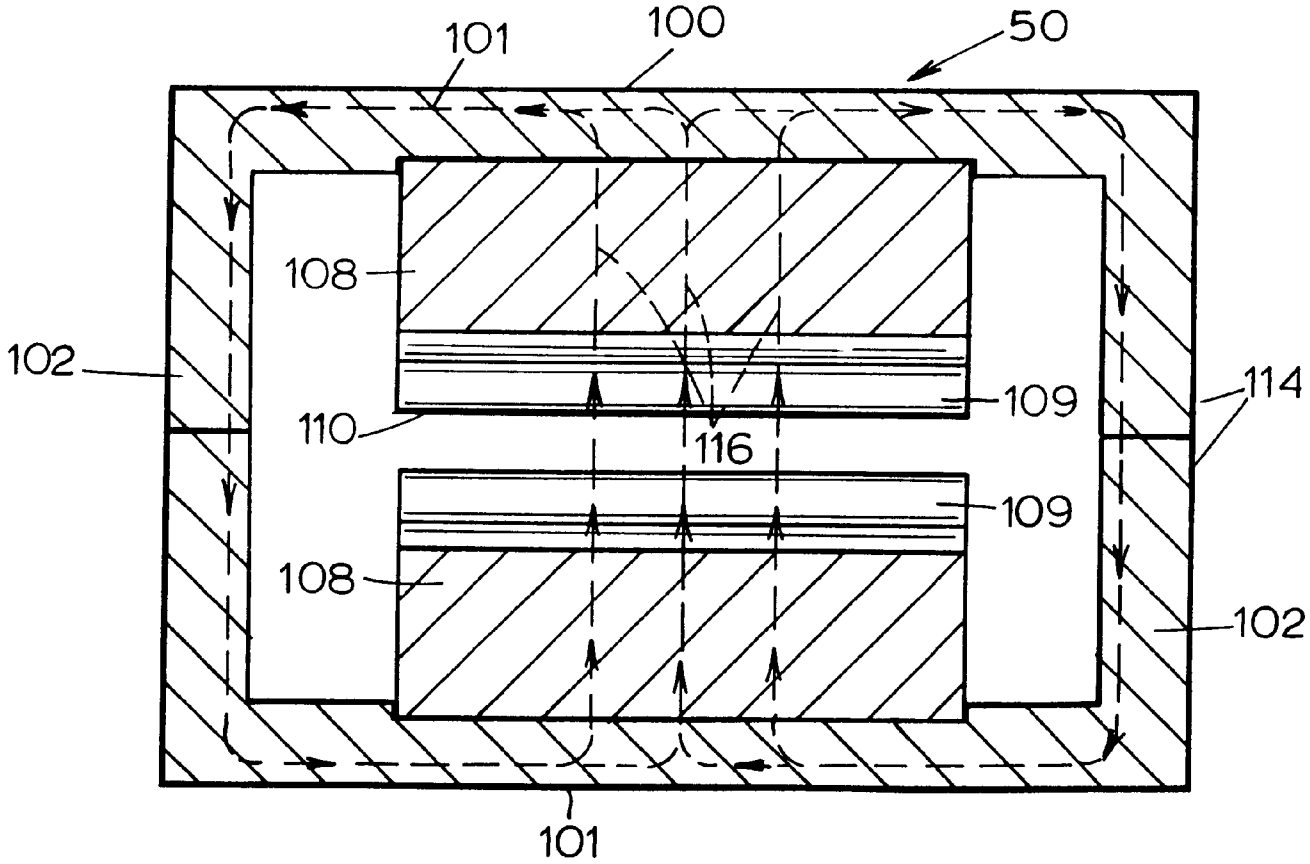
FIG. 16 is a horizontal sectional view taken along line 16—16 in FIG. 13.

Electromagnet 50 also comprises a pair of pole members 108, 108 each composed of magnetic material and each mounted on a respective sidewall 101 of outer member 100, within vertically disposed space 104. Each pole member 108 extends inwardly within space 104 toward the other pole member and terminates at a pole face 109 which is opposed to and faces the pole face 109 on the other pole member 108 (FIGS. 2 and 16). Pole faces 109, 109 define a gap 110 therebetween, to accommodate vessel 38. As shown in FIG. 14, encompassing each pole member 108 is a coil 112 for conducting electric current. In accordance with the present invention, a time-varying current is flowed through each coil 112 to generate a magnetic field within the pole member 108 encompassed by that coil 112.

Pole members 108, 108 and outer member 100 provide a path 116 for the magnetic field described in the preceding paragraph. Flow path 116 is shown in dashed lines, with arrows, in FIG. 16. More particularly, the magnetic field extends from a pole face 109 on one pole member 108 across gap 110 to the pole face 109 on the other pole member 108. The magnetic field then extends sequentially through the other pole member 108, then in opposite directions through the longitudinal sidewall 101 on which that other pole member 108 is mounted, then through both end walls 102, 102 of outer member 100, then through the longitudinal sidewall 101 on which the one pole member 108 is mounted and then through the one pole member 108 back to the pole face 109 on that pole member.

The direction of current flow through each coil 112 on each of pole members 108 is controlled so that the magnetic field generated by each of the coils on each of the pole members extends across gap 110 in the same direction.

Figure 13:
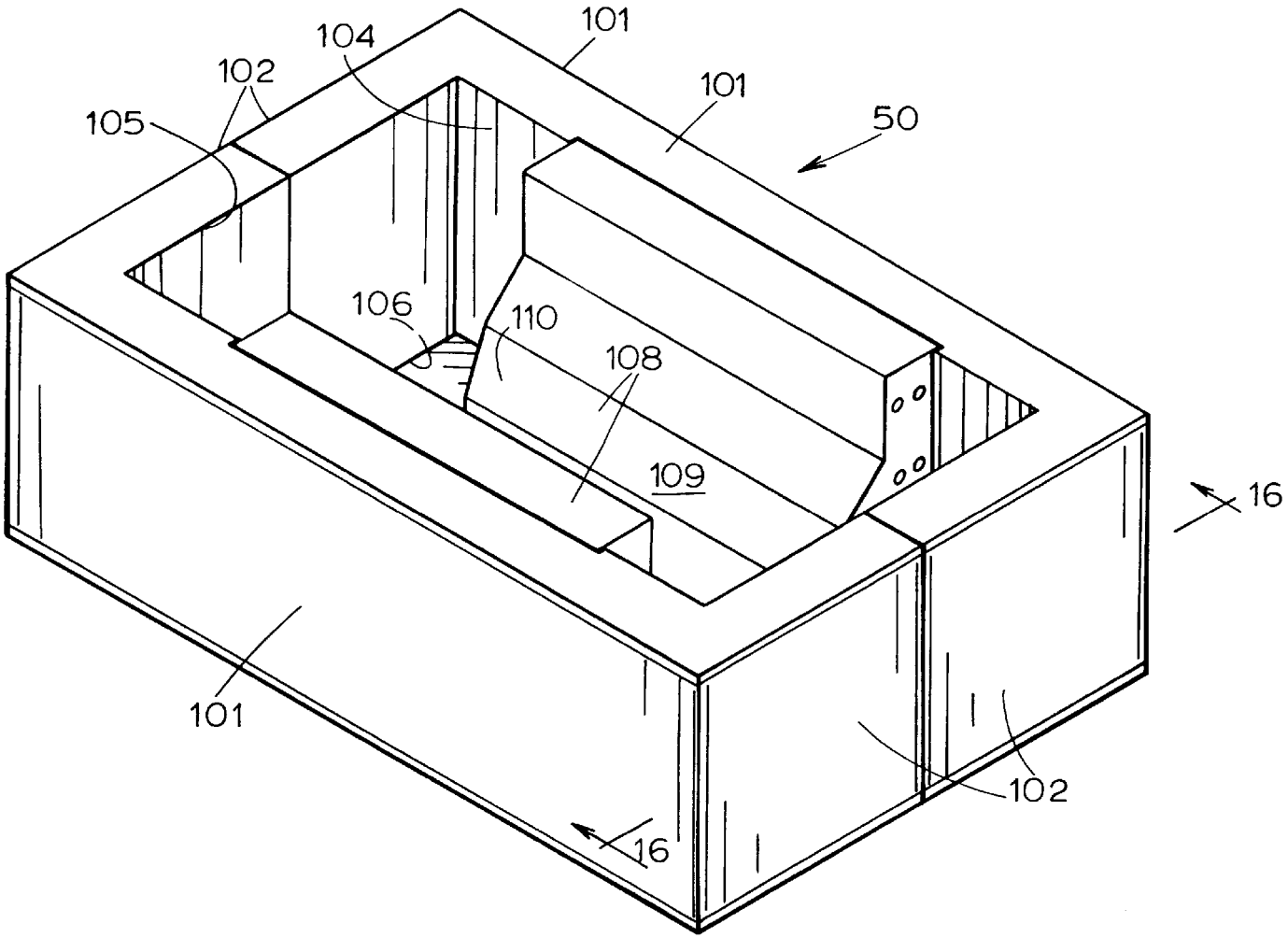
FIG. 13 is a perspective of an electromagnet for use in a hot dip coating system in accordance with the present invention.

As seen in FIGS. 13 and 16, electromagnet 50 is composed of two half magnets 114, 114 each having an E-shaped horizontal cross section.

Referring to FIG. 2, each pole face 109 of pole member 108 has a generally convex contour which follows the concave contour of the adjacent sidewall portion 61 of vessel 38. The distance between opposed mutually facing pole faces 109, 109 (gap 110) is shortest at that portion of the narrow vessel part 58 which is immediately downstream of plug 46 and which corresponds with location 47 in bath 40. Because pole face gap 110 is shortest at that location, the magnetic field strength (flux density) is highest at that location, compared to other bath locations downstream of plug 46. Accordingly, for a given current flowing through coils 112, 112, the magnetic force exerted against bath 40 by electromagnet 50 is higher at location 47 (immediately downstream of plug 46) than at any other location in molten metal bath 40.

The horizontal magnetic field which is generated at bath location 47 has a relatively high magnetic flux density. The magnetic flux induces eddy currents which travel in a looped path 117 within bath 40 (FIG. 10). The path of the eddy currents includes a portion 118 (FIG. 10) which extends horizontally in the longitudinal direction of vessel 38 at bath location 47. The direction of the eddy currents there is 90° to the direction of the magnetic flux there. As a result, the flux and the eddy currents intersect in a horizontal plane, resulting in magnetic forces directed in an upward direction, as viewed in FIGS. 2 and 10. These forces urge that part of bath 40 which is located immediately downstream of plug 46 (at location 47), in an upward direction away from plug 46 and away from opening 43, i.e. downstream as viewed in FIG. 2.

Figure 28:
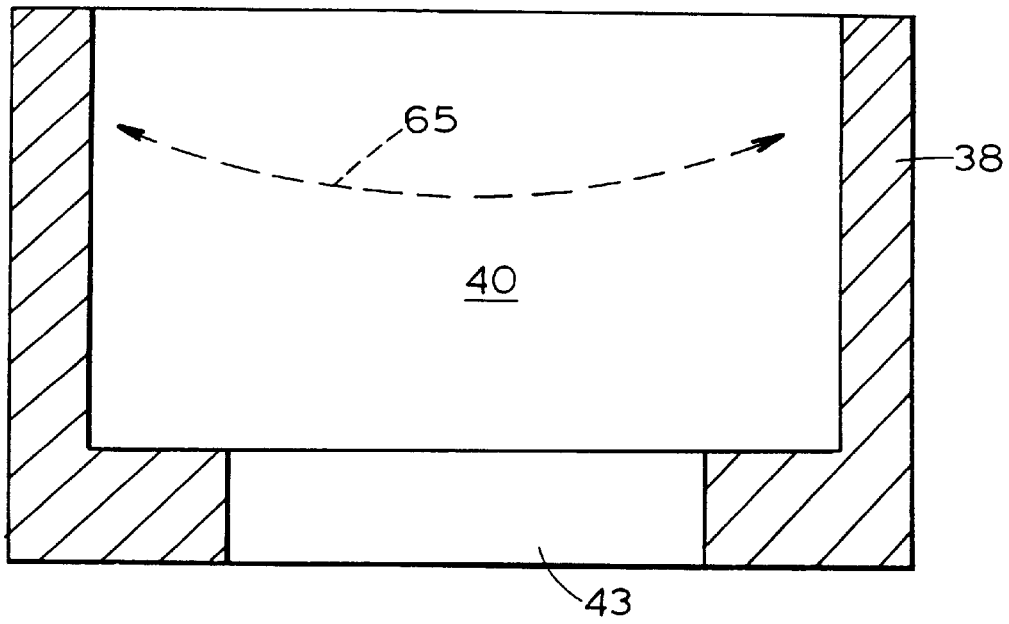
FIGS. 28 and 29 are longitudinal sectional views of the vessel diagrammatically illustrating different types of agitation streams in the coating bath.
Figure 29:
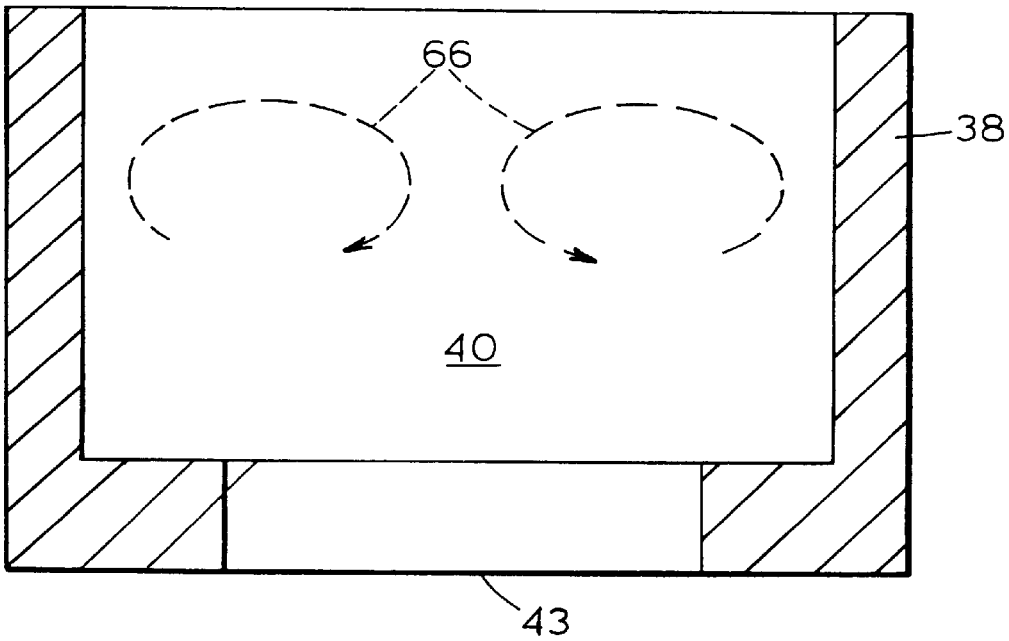

The magnetic flux and the eddy currents which produce the aforementioned upwardly directed magnetic forces in bath 40 (FIG. 10) also cause agitation in bath 40 in the form of agitation streams having portions which can flow across the top of plug 46 and which, in doing so, can cause erosion of the plug, which is undesireable. More particularly, referring to FIGS. 28 and 29, these figures diagrammatically illustrate two different types of agitation streams which can occur in bath 40, depending upon the power at which electromagnet 50 is operating and the flux it produces in bath 40. At relatively low magnet power and flux, agitation in bath 40 may be manifest as roiling agitation streams, shown representationally at 66 in FIG. 29. At higher magnet power and flux, agitation in bath 40 may be manifest as back and forth sloshing, shown representationally at 65 in FIG. 28. At still higher magnet power and flux (e.g., above 75% of maximum power, in one embodiment), agitation in bath 40 is again manifest as roiling (66 in FIG. 29).

When roiling occurs (FIG. 29) erosion of plug 46 is relatively small; when back and forth sloshing occurs (FIG. 28), erosion of plug 46 increases substantially. If roiling is produced by operating at relatively low magnet power and flux, erosion of plug 46 may be reduced; however, the resulting magnetic field may be so weak as not to provide the heating required at that part of the molten metal bath at location 47 immediately downstream of plug 46, which is undesireable. Accordingly, a preferred way of controlling erosion of plug 46 is to operate at a magnet power and flux above that which produces the back and forth sloshing action illustrated in FIG. 28, and instead produces the roiling action illustrated in FIG. 29. In addition, the higher the magnet power and flux, the greater the levitating effect produced at bath location 47 by the interaction of the magnet flux and the eddy currents there.

Generally, magnet power (and flux) can be adjusted by adjusting the amperage of the time-varying current employed to energize the magnet.

Magnetic levitation in accordance with the present invention produces an upwardly directed force against bath 40 at bath location 47 to relieve substantially the downward pressure of bath 40 on plug 46, but there is still contact between bath 40 and the top of plug 46. When vessel 38 is composed of stainless steel, the molten coating metal retained at location 47 has a cooling effect on the walls of vessel 38 at location 47, absorbing much of the heat generated by the magnetic field there. In the absence of molten coating metal there, the heat generated there by magnet 50 could burn a hole in the stainless steel wall.

The magnetic levitation (upward force) exerted against that part of the molten metal bath at location 47 is a factor in bulk containment of the molten metal bath. Without plug 46, the magnetic levitation described above could produce bulk containment of bath 40 of about 98% or more when other expedients, which enhance the effect of magnet 50, are associated with the magnet. Bulk containment due to magnetic levitation of the type described in the preceding sentence can be successful in preventing the escape through strip passage opening 43 of most of the molten coating metal from bath 40, but it cannot prevent dripping or leakage downwardly along sides 63, 63 and ends 64, 64 of opening 43 (FIG. 10). That function, however, is performed by plug 46.

Referring now to FIG. 14, coil 112 on pole member 108 is connected to a device 113 for varying the amperage of the time-varying current introduced into coil 112, in this manner enabling one to control the strength of the magnetic field generated by electromagnet 50.

Coil 112 is composed of a multiplicity of coil turns 115 each extending around pole member 108 and each composed of a suitable conductive material such as copper. Coil turns 115 are insulated from each other and from pole member 108 with conventional electrical insulating material (not shown). In the embodiment illustrated in FIG. 14, coil 112 is shown composed of solid wire; in other embodiments, the coil may be composed of copper tubing, for example, through which a cooling fluid may be circulated.

Electromagnet 50 is composed of a conventional magnetic material such as ferrite or laminations of electrical steel.

Figure 5:
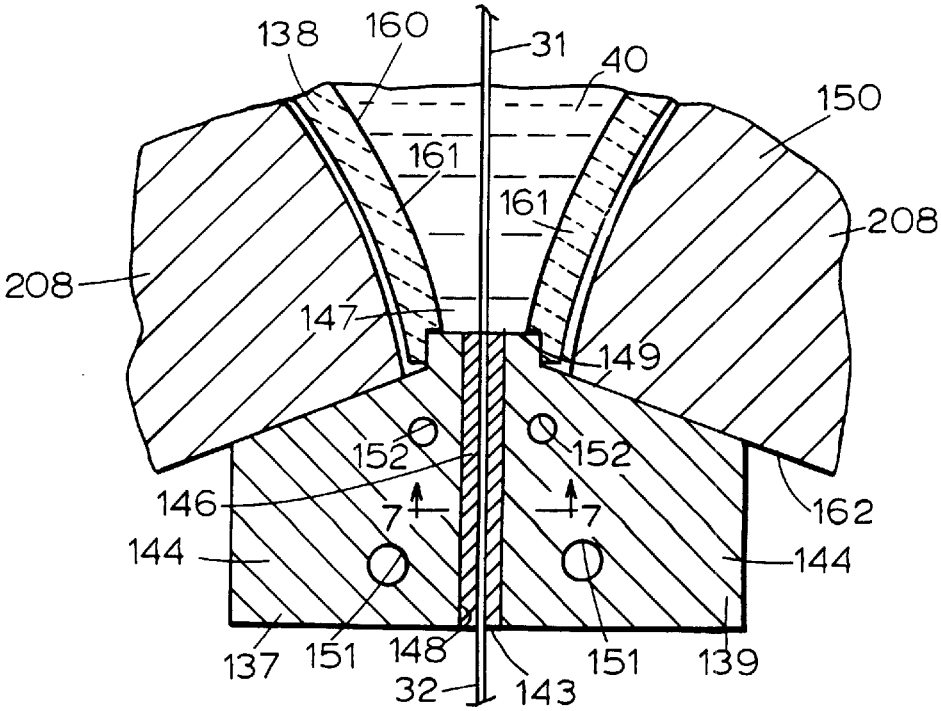
FIG. 5 is fragmentary, vertical sectional view of a portion of the system of FIG. 3.
Figure 4:
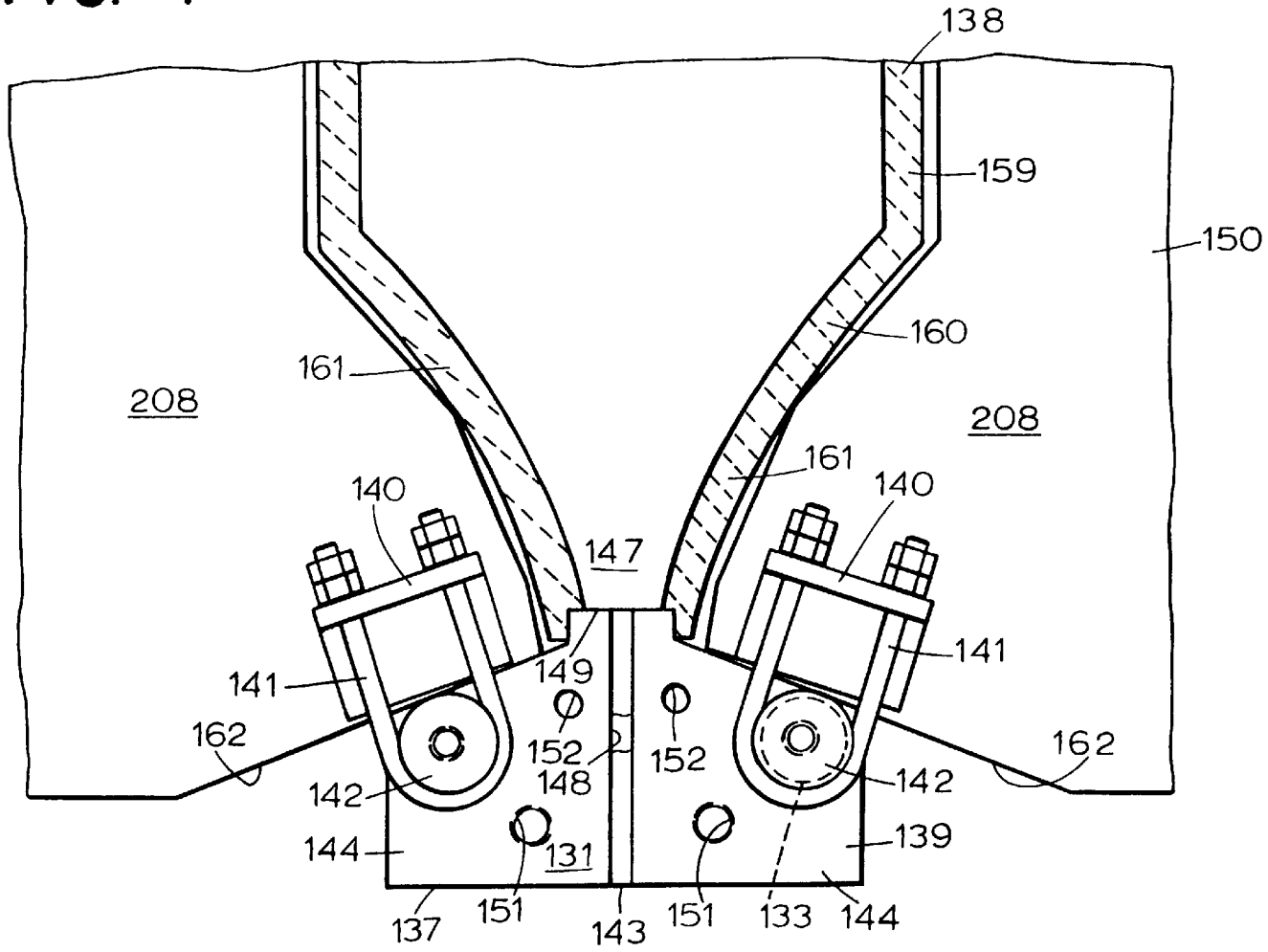
FIG. 4 is a fragmentary end view, partially in section, and partially cut away, of a portion of the system of FIG. 3.

Referring now to FIGS. 3–5, indicated generally at 130 in FIG. 3 is a hot dip coating system constructed in accordance with another embodiment of the present invention. Located upstream of system 130 (to the left in FIG. 3) is the downstream part 134 of an apparatus for subjecting uncoated strip 32 to a pre-treatment operation. The pre-treatment to which strip 32 is subjected in the embodiment of FIG. 3 subjects the strip to a reducing atmosphere (e.g., hydrogen) at downstream apparatus part 134. This reducing atmosphere is maintained between apparatus part 134 and hot dip coating system 130 by an enclosure 135 which extends from apparatus part 134 to hot dip coating system 130, in the manner shown in FIG. 3. Located within enclosure 135 are guide rolls 36, 37 for directing strip 32 from pre-treatment apparatus part 134 to hot dip coating system 130.

The pre-treatment operation to which strip 32 is subjected at 134 and upstream thereof is a conventional treatment familiar to those skilled in the hot dip coating art, and is used in lieu of applying a flux to strip 32 prior to the strip's entry into the hot dip coating bath.

Referring now to FIGS. 4–5, hot dip coating system 130 comprises a vessel 138 having a bottom, upstream opening 149. Located immediately upstream of vessel 138, at bottom opening 149, is a chilling element 139 constituting an upstream extension of vessel 138. Chilling element 139 contains a lower, upstream, strip passage opening 143 which corresponds to strip passage opening 43 in vessel 38 of system 30 (FIG. 2). Extending downstream from strip passage opening 143 is a strip passageway 148 (at the partial cut-away in FIG. 4) corresponding to narrow part 58 of vessel 38 in system 30 (FIG. 2). Passageway 148 has a downstream end which communicates with bottom opening 149 in vessel 138.

In system 130, the chilling step is performed by chilling element 139 to produce a plug 146 which surrounds strip 32 in strip passageway 148 (FIG. 5). Plug 146 extends from strip passage opening 143 downstream in strip passageway 148 toward bottom opening 149 of vessel 138. Plug 146 fills the space in passageway 148 not occupied by strip 32, and plug 146 is substantially stationary relative to moving strip 32.

Chilling element 139 forms and maintains plug 146 while strip 32 undergoes coating in molten metal bath 40 to produce coated strip 31. Plug 146 prevents the escape of molten coating metal from bath 40 through strip passage opening 143. An additional expedient, in the form of a mechanical gate or seal, is employed at the very beginning of a hot dip coating operation to prevent the escape of molten metal from bath 40; this will be described later.

Chilling element 139 is mounted at the bottom of vessel 138 by an arrangement illustrated in FIG. 4. Associated with vessel 138 is an electromagnet 150 having a pair of pole members 208, 208 each mounting, at a lower portion thereof, a bracket 140 carrying a U-shaped, threaded connector 141 engaging within a circumferential slot 133 in a pin 142 extending outwardly from an end of chilling element 139.

Vessel 138 comprises a wide upper part 159 and a lower part 160 having converging sidewalls 161, 161 terminating at the bottom of vessel 138. Unlike vessel 38 in system 30 (FIGS. 1–2), vessel 138 has no narrow, neck-like lowermost part corresponding to narrow part 58 in vessel 38 (FIG. 2). As previously noted, passageway 148 in chilling element 139 replaces narrow part 58 in vessel 38.

Figure 15:
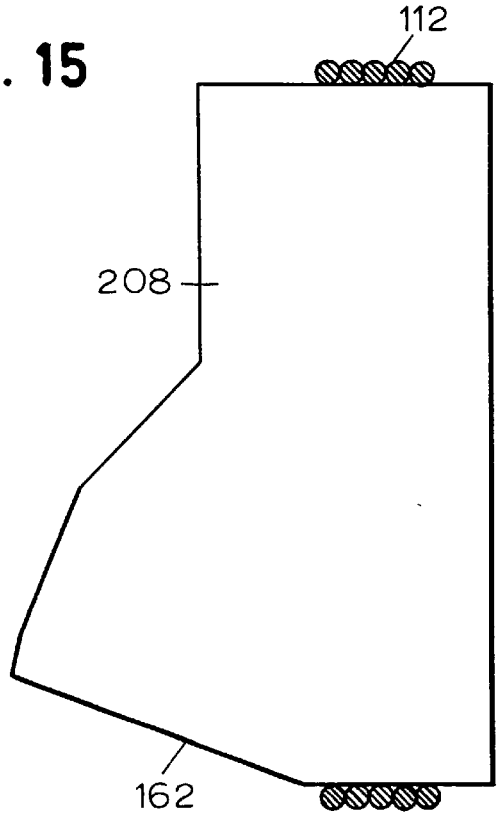
FIG. 15 is an end view, similar to FIG. 14, showing a modified version of the electromagnet portion illustrated in FIG. 14.

Another difference between the apparatus of system 130 and the apparatus of system 30 is as follows: each pole member 208 of electromagnet 150 in system 130 is cut away along its bottom at 162 to accommodate chilling element 139 (FIGS. 4 and 15). In this regard, compare the flat bottom 49 of pole member 108 of electromagnet 50 (FIGS. 2 and 14) with the cut-away, angled bottom 162 of pole member 208 of electromagnet 150 (FIG. 4 and 15).

In the embodiment employing system 130, strip 32 enters strip passage opening 143 (FIG. 5) at a temperature corresponding substantially to the temperature of molten metal coating bath 40 (e.g. 435°–470° C. (815–878° F.)). Typically, strip 32 enters strip passage opening 143 at a temperature of about 450° C. (842° F.). In system 30 of FIGS. 1–2, the chilling effect was produced by strip 32 entering strip passage opening 43 at a temperature substantially below the temperature of molten metal coating bath 40. However, in system 130, strip 32 enters strip passage opening 143 at substantially the same temperature as the molten metal coating bath; therefore strip 32 cannot perform a chilling function in system 130. Hence, the employment of chilling element 139 to perform that function.

The discussion in the preceding paragraph assumes that strip 32 has been heated in an upstream pre-treatment apparatus employing a hydrogen-reducing atmosphere, and that the strip has not been subjected to a cooling step of any significance after the pre-treatment. In another embodiment of the present invention, in which strip 32 is subjected to a pre-treatment employing a hydrogen-reducing atmosphere, strip 32 is then cooled upstream of vessel 138, from a relatively high temperature, at or above the temperature of bath 40, to a relatively low temperature substantially below the bath temperature (e.g., to a temperature below 120° C. (248° F.)). At that low temperature, strip 32 can act as a chilling medium (as does the strip in the embodiment of FIG. 2), and chilling element 139 need not be employed.

The following discussion is directed to that embodiment of the present invention which does employ chilling element 139 to perform the chilling function.

The manner in which chilling element 139 performs the chilling function, and some of the structural details of chilling element 139, will now be described with reference to FIGS. 4, 5 and 17.

Chilling element 139 comprises two chilling element halves 144, 144 each composed of a material, such as non-magnetic stainless steel, which is a relatively good thermal conductor and has a melting point substantially greater than the temperature of molten metal coating bath 40. The chilling element may also be composed of a ceramic material that is sufficiently thermally conductive to perform the chilling function.

When assembled together, each chilling element half 144 is the mirror image of the other. Chilling element halves 144, 144 are maintained in spaced-apart relation by end spacers 145, 145 (FIG. 17) composed of refractory material and located at opposite ends of chilling element 139; chilling element passageway 148 is defined in the space between the two chilling element halves, intermediate the end spacers.

Each chilling element half 144 has a lower first channel 151 through which a cooling fluid can be circulated, and an upper second channel 152 through which a cooling fluid can be circulated. First channel 151 is located relatively close to strip passage opening 143, and second channel 152 is located downstream of first channel 151.

The chilling effect produced by chilling element 139 results from the circulation of cooling fluid through channels 151 and 152. The chilling effect can be controlled by controlling the number of cooling channels through which cooling fluid is circulated, and this will be described in more detail later. In the embodiment illustrated in the drawings, chilling element 139 is shown as having two cooling channels, 151 and 152. One or more additional cooling channels can be provided, if desired.

In the embodiment of system 130 illustrated in FIGS. 3–5, the bath is heated immediately downstream of plug 146 by electromagnet 150 which is essentially identical to magnet 50 of system 30 except for the cut-away part 162 at the bottoms of pole members 208, 208, as described above. The structure and function of magnet 150 is essentially otherwise identical to the structure and function of magnet 50, unless otherwise indicated.

The mass of plug 146 is determined by the length of the plug. Plug 146 should have a length sufficient to support the weight of the molten metal bath above plug 146. If the plug is too short, it could be forced downwardly and out of bottom opening 143 in chilling element 139 by the weight of the molten metal bath bearing downwardly against plug 146. In addition, if the plug is too short, the plug could be susceptible to a localized melt-through due, primarily, to the heat of the molten metal bath located above the plug.

On the other hand, if plug 146 is too long, the friction of the plug against the surface of strip 32 could create too much drag on strip 32 as the strip moves downstream through plug 146, and this is undesireable. This drag increases substantially as the length of plug 146 increases. It is desireable to keep the drag at a relatively low level. Generally, the length of the plug should be just long enough to assure mechanical support of the weight of the molten metal coating bath above the plug and to prevent localized melt-through. Any length greater than that is unnecessary and creates additional drag which is undesireable.

The length of plug 146 in a direction downstream from opening 143 can be controlled by controlling the chilling effect produced by chilling element 139 and by controlling the heating effect produced by electromagnet 150. Circulating a cooling fluid through lower, first cooling channel 151 of chilling element 139 can be employed to form plug 146, and circulating a cooling fluid through upper, second cooling channel 152 can be employed to increase the length of plug 146.

Curtailing the circulation of cooling fluid through second channel 152 will decrease the length of plug 146. The heating effect produced by electromagnet 150 at bath location 147 immediately downstream of plug 146 can also be employed to decrease the length of plug 146, thereby decreasing the drag exerted against strip 32 by plug 146. In other words, the heating effect produced by electromagnet 150 and the curtainment of cooling fluid circulation through second channel cooperate to decrease the length of plug 146.

Controlling the heating effect produced by electromagnet 150 can also be employed as an expedient for maintaining bath 40 at a stable temperature in system 130, just as electromagnet 50 is employed to do that in system 30.

In summary, system 130 is controlled so as to provide plug 146 with a length sufficient (a) to resist being pushed in an upstream direction by the pressure of bath 40 located downstream of plug 146 and (b) to resist a localized melt-through due to the heat of the bath. In addition, the system is controlled to provide plug 146 with a length short enough to avoid excessive drag on strip 32 as the strip moves downstream through plug 146.

FIG. 21 is a flow diagram illustrating an arrangement for circulating cooling fluid through chilling element 139 and for controlling cooling fluid circulation. A tank 164 contains a cooling fluid, typically water at ambient temperature. Connected to tank 164 is an outlet line 165 connected to branch lines 167*a*, 167*b* each of which leads to a cooling element half 144. Each branch line 167*a*, 167*b* in turn communicates with a line 153 leading to lower, first fluid cooling channel 152 in a cooling element half 144. The volume of fluid flowing through line 153 and channel 151 is controlled by valve 155 on line 153 and is measured by a flow meter 154 on line 153. Also communicating with branch line 167*a* or 167*b* is a line 156 leading to upper, second fluid cooling channel 152 in a chilling element half 144. The flow of fluid through line 156 and second channel 152 is controlled by valve 158 on line 156 and is measured by a flow meter 157 on line 156.

Connected to first fluid cooling channel 151 is an outlet line 169, and connected to second fluid cooling channel 152 is an outlet line 170. Outlet lines 169, 170 join downstream with a withdrawal line 171. The temperature of the cooling fluid in supply line 165 from tank 164 is measured by a thermocouple 166 on line 165. The temperature of the fluid leaving cooling element 139 is measured by a thermocouple 172 on withdrawal line 171.

Plug 146 can be formed by opening valves 155, 155, while valves 158, 158 remain closed. The length of plug 146 may be increased by opening valves 158, 158, preferably to a fully open position. Partially opening valves 158, 158 has a lesser effect on the extent to which the length of plug 146 increases. The length of plug 146 can be decreased to an extent by fully closing valves 158, 158 to decrease the flow of fluid through the chilling element; however, the effect of this expedient on decreasing the plug length is not as substantial as a substantial increase in the heating effect produced by electromagnet 50 at bath location 47.

Generally, during operation of system 130, valves 155, 155 are fully open, while valves 158, 158 may be closed, partially open ed, or fully opened, depending up on the length of plug 146 in channel 148 and the need to increase or decrease the length of plug 146. Also, as previously noted, the length of plug 146 can be decreased by increasing the heating effect produced by electromagnet 150 at bath location 147 immediately downstream of plug 146 (FIG. 5). In summary, various combinations of (i) increased or decreased heating effect from electromagnet 150 and (ii) increased or decreased chilling effect from chilling element 139 can be employed to control the length of plug 146. The appropriate combination, for a given set of operating conditions and parameters for system 130, can be determined empirically.

The heating effect at bath location 147 immediately downstream of plug 146 may also be produced by other heating expedients illustrated in FIGS. 18–20, and these expedients will now be described.

Figure 18:
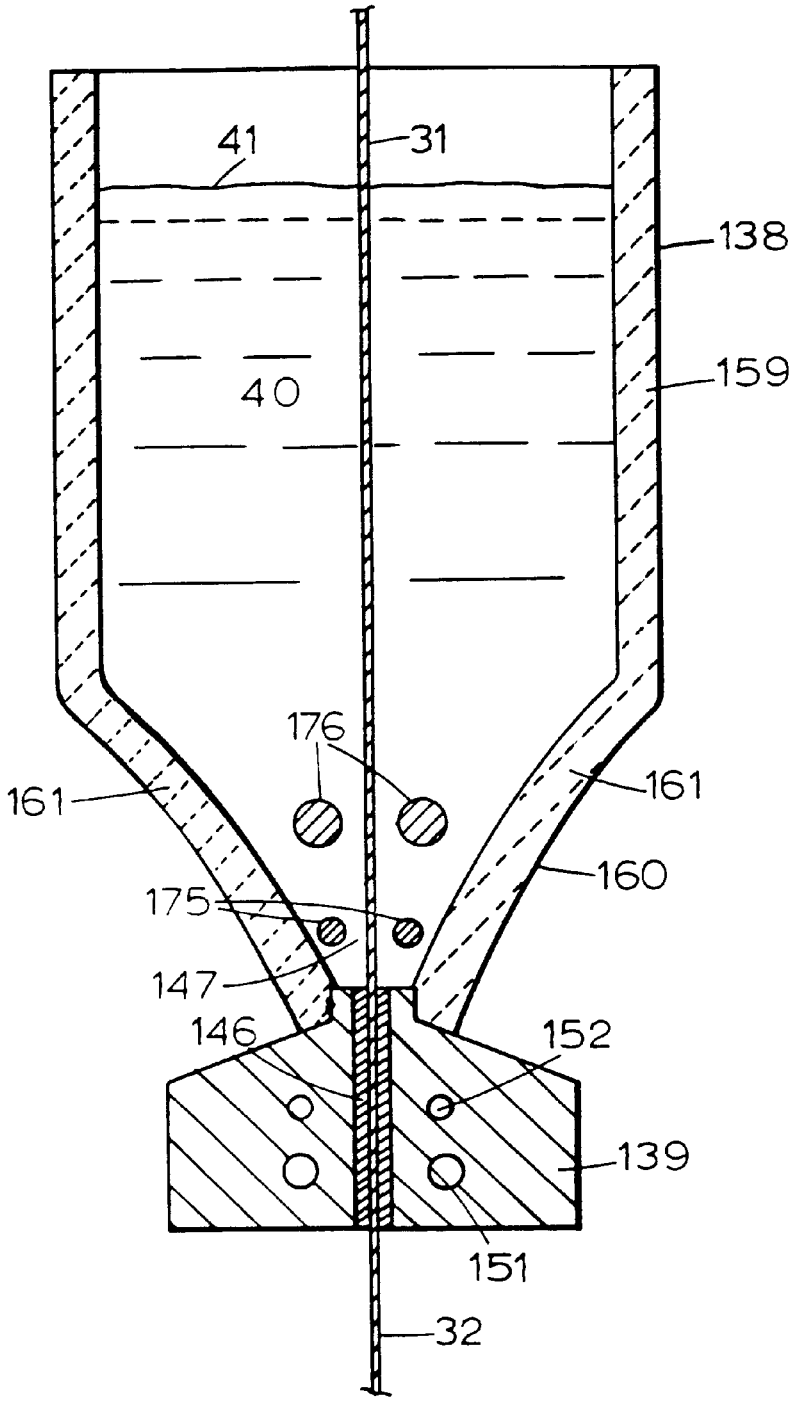
FIG. 18 is a vertical sectional view illustrating a variation of the equipment shown in FIGS. 4–5.

In FIG. 18, the heating expedient comprises resistance heating elements in the form of rods 175, 176 disposed in bath 40 at bath location 147, and adjacent thereto, to subject the bath to conduction heating at location 147. Resistance heating elements are a commercially available expedient conventionally employed by those skilled in the art to heat molten metal baths.

The heating expedient employed in FIG. 19 is an induction heating element 177 disposed around that part of vessel 138 containing bath location 147. Induction heating element 177 comprises a coil 178 composed of a plurality of turns or loops 179 and a member 180 composed of magnetic material for concentrating, at bath location 147, the magnetic field developed by coil 178. Magnetic member 180 is composed of conventional magnetic material, e.g. ferrite or laminations of electrical steel. Coil 178 is composed of copper. Coil turns 179 may be solid as shown in FIG. 19 or they may be tubular to enable one to circulate a cooling fluid through the tubular coil turns. Coil 178 and its coil turns 179 totally encompass that part of vessel 138 which contains bath location 147.

A variation of the induction heating element 177 of FIG. 19 is shown at 187 in FIG. 20. Induction heating element 187 comprises a coil 188 composed of a plurality of turns 189 each composed of a plurality of wires 191, 191 connected together, as by brazing, to form a coil turn 189 having an elongated vertical cross-section as shown in FIG. 20. Heating element 187 also comprises a magnetic member 190, similar to magnetic member 180 in FIG. 19 and performing a similar function.

In lieu of solid wires 191, 191 of which coil turns 189 are composed, one may employ tubular elements (192 in FIG. 20*a*) composed of copper, for example, and brazed together in the manner shown in FIG. 20*a*. When one employs tubular elements 192 (FIG. 20*a*) in lieu of solid wires 191 (FIG. 20) one is able to circulate a cooling fluid through the coil turns.

Another variation of coil turn is shown at 193 in FIG. 20*b* wherein coil turn 193 is composed of a single tube having an elongated, rectangular, vertical cross-section. A configuration like that shown at 193 in FIG. 20*b* facilitates the circulation of cooling fluid through the coil.

The induction heating elements illustrated in FIGS. 19, 20, 20*a* and 20*b* produce a magnetic field at bath location 147 which is sufficient to provide the desired heating effect but is insufficient to produce a magnetic levitation effect at bath location 147. As previously noted, electromagnet 150 (FIGS. 4 and 5) can produce a magnetic levitation effect at bath location 147.

Although the induction heating expedients (FIGS. 19 and 20–20*b*) cannot produce a magnetic levitation effect, they do have an advantage over the expedient of FIGS. 4–5 which employs electromagnet 150. The expedient of FIGS. 4–5 can create an attractive force between steel strip 32 and magnetic pole members 208, 208 (FIG. 5). If strip 32 moves off the exact center line between pole members 208, 208, the attraction to the nearer pole member increases, and this can make it difficult to keep strip 32 centered. When one employs the induction heating expedients of FIGS. 19 and 20–20*b*, however, displacement of strip 32 off of the exact center line is not a problem; in fact, the use of these induction heating expedients to provide the heating effect tends to keep strip 32 centered between the two opposed sides of the heating element (e.g., 181, 182 in FIG. 19).

The heating expedients of FIGS. 18–20, 20*a* and 20*b* are illustrated in these figures in conjunction with system 130 which employs chilling element 139 to perform the chilling effect and produce the plug. However, these same heating expedients can also be employed with system 30 where the desired chilling effect is performed by strip 32, and where the chilling effect is controlled by controlling the temperature and speed of strip 32 as it enters strip passage opening 43.

FIGS. 22–25 illustrate a mechanical gate or bottom seal arrangement for use in preventing the escape of molten coating metal from bath 40 through the strip passage opening in the absence of a plug of solidified coating metal. That situation (absence of a plug) typically occurs at the beginning of a hot dip coating operation before the plug has been formed.

The mechanical gate is also employed when one changes the width of the strip being coated. In such a situation, the gate is closed before the strip width is changed, and the plug is then melted, e.g., by discontinuing the chilling effect while continuing the heating effect; then a strip having a different width than the strip previously coated is pulled through the gate and the bath, the plug is refrozen, and the gate is then opened.

The mechanical gate or bottom seal arrangement will be discussed below in the context of vessel 38 and electromagnet 50, but a mechanical gate arrangement is not limited to that embodiment.

Underlying vessel 38 and pole members 108, 108 of electromagnet 50 is a frame 200 having a depending flange 201 which is spaced from and parallel to the plane of end wall 56 of vessel 38 (FIG. 8). Associated with narrow part 58 of vessel 38, at the lowermost end of narrow part 58, is an elongated seal ring 202 which surrounds the bottom end of narrow part 58. Located below seal ring 202 are a pair of gate members 204, 205 each in the form of an elongated seal bar having a triangular cross-section. Referring to FIG. 22, each gate member 204, 205 is mounted for movement between (i) a closed position for preventing the escape of molten metal from bath 40 through opening 43 (solid lines) and (ii) an open position displaced from the closed position (dash dot lines). Each gate member 204, 205 is connected to a respective carrier bar 207, 208 by connecting structure which will be described below. Each carrier bar 207, 208 is fixed on a respective link member 209, 210 each of which is carried by, and mounted for pivotal movement with, a respective pivot shaft 211, 212 each rotatably mounted on frame 200.

Referring to FIG. 23, link member 209 is pivotally connected at 216 to an intermediate link member 214 in turn pivotally connected at 215 to link member 210. As a result of the linkage described in the preceding sentence, each link member in the pair 209, 210 will pivot in response to pivotal movement of the other link member in that pair. A handle (not shown) is connected to either shaft 211 or shaft 212 to initiate pivotal movement of the link members which in turn causes arcuate movement of seal gate members 204, 205 between their closed and open positions.

The manner in which gate members 204, 205 are mounted on their respective carrier bars 207, 208 will now be described with reference to FIGS. 22 and 26. This description is in the context of gate member 204 and its carrier bar 207, it being understood that the same description is applicable to gate member 205 and its carrier bar 208.

Carrier bar 207 contains a recess 218 for receiving the head 219 of a shoulder bolt 220 which slidably extends through an opening 224 in carrier bar 207 and into a bore 221 in gate member 204. Shoulder bolt 220 has a terminal end 222 which is fixed in gate member 204 to attach the shoulder bolt to the gate member. A coil spring 223 is received in bore 221 in gate member 204 and bears against the adjoining surface 228 of carrier bar 207. Carrier bar 207 is fixed on its link member 209, but the only connection of gate member 204 to link member 209 is by shoulder bolt 220 which is axially movable relative to carrier bar 207.

Coil spring 223 in bore 221 of gate member 204 urges gate member 204, and attached shoulder bolt 220, in a direction along the axis of shoulder bolt 220, away from carrier bar 207. Recess 218 in carrier bar 207 is deep enough to permit axial movement therein of head 219 on shoulder bolt 220. The action of coil spring 223, urging gate member 204 away from carrier bar 207, also urges gate member 204 toward engagement with seal ring 202 at vessel narrow part 58 and toward engagement with strip 32 (FIG. 24).

The combination of bore 221 and coil spring 223, for urging gate member 224 away from carrier bar 207, and into sealing engagement with seal ring 202 and strip 32, is provided at a plurality of locations along the length of gate member 204 (and gate member 205). In a commercial-scale hot dip coating system, gate member 204 may be up to eight feet long (2.44 m), for example. In a gate member of that length, the combination of coil spring 223 and bore 221 would be placed (i) at locations adjacent each end of gate member 204 and (ii) at a plurality of intermediate locations, positioned between the two end locations and spaced apart along the length of gate member 204.

The arrangement described in the preceding paragraph distributes the sealing pressure exerted by gate member 204 substantially equally along the length of the gate member. The same arrangement also helps to correct for errors in the positioning of carrier bar 207, in relation to seal ring 202, when carrier bar 207 is in the closed position illustrated in full lines in FIG. 22.

When gate member 204 is in its closed position (full lines in FIG. 22, and FIG. 24), gate member 204 has a horizontal surface 225 for engaging seal ring 202 and a vertical surface 226 for engaging strip 32 (FIG. 24). The engagement between gate member 204 and seal ring 202, described in the preceding sentence, occurs when gate member 204 and its associated structure are used with system 30 (FIGS. 2 and 22), a system which does not employ a separate chilling element below vessel 38. When gate member 204 and its associated structure are used with system 130, which employs chilling element 139 (FIGS. 4–5), there is no seal ring, such as 202 in FIG. 22, for gate member 204 to engage; instead, horizontal surface 225 on gate member 204 engages the bottom surface 137 of chilling element 139.

Surfaces 225, 226 on gate member 204, are covered with a layer 227 of soft, flexible, refractory sealing material. As shown in FIG. 24, sealing material layer 227 (i) sealingly engages seal ring 202 at the bottom end of vessel narrow part 58, (ii) sealingly engages the adjacent surface of strip 32, and (iii) sealingly closes strip passage opening 43. As strip 32 moves in a downstream direction at the start of the hot dip coating operation, sealing material layer 227 functions as a wiper for sealingly engaging the adjacent side surface of strip 32, to help prevent the escape of molten metal.

Gate member 204 and sealing material layer 227 each have a dimension, in the direction of the width of strip 32, which is greater than the width of strip 32 (FIG. 25). Accordingly, layer 227 extends laterally beyond the vertical edge 48 of strip 32. The same dimensional relationship exists between strip 32 and layer 227 on the other gate member 205. As a result, layer 227 on vertical surface 226 of gate member 204 sealingly engages with layer 227 on vertical surface 226 of opposite gate member 205, at edge 48 of strip 32 and beyond (FIG. 25). This prevents leakage of molten coating metal from bath 40 along the edge 48 of strip 32.

A start-up procedure for a hot dip coating operation, employing gate members 204, 205 and the structure associated therewith will now be described.

Vessel 38 is initially provided in an empty condition, without hot dip coating bath 40. Strip 32 is positioned upstream and downstream of vessel 38 and occupies that part of the strip path which extends through strip passage opening 43 and vessel 38. Gates 204, 205 are moved to the closed position shown in full lines in FIG. 22. Molten coating metal is then introduced into vessel 38. Gates 204, 205 and their associated structure prevent the molten coating metal from escaping through strip passage opening 43. Strip 32 is moved downstream along its path as the molten coating metal is introduced into vessel 38. As described above, the movement of strip 32 through bath 40 chills the molten coating metal at a location downstream of strip passage opening 43 to form plug 46 there. Once plug 46 has formed and has grown to a size large enough to support bath 40, gate members 204, 205 can be pivoted to the open positions shown in dash-dot lines in FIG. 22. The minimum plug length required to support bath 40 can vary from bath to bath and can be determined empirically.

Initially during the start-up procedure, that part of bath 40 downstream of the location where plug 46 is formed (location 47 in FIG. 2) is not heated. Once plug 46 has formed and has the desired size, bath 40 is heated immediately downstream of plug 46 (location 47 in FIG. 2), for the reasons described above.

In one embodiment of the start-up procedure, it is proposed that pieces of cold metal shot, composed of the coating metal, be placed immediately downstream of strip passage opening 43, atop gate members 204, 205, prior to introducing molten coating metal into vessel 38. It is proposed that placing the cold metal shot atop gate members 204, 205 can enhance the chilling of the initial molten coating metal which arrives there.

Typically, a layer of cold shot having a depth of about 1–2 inches (25.4–50.8 mm) can be placed atop gate members 204, 205. It is proposed that that amount of shot can produce relatively rapid quenching of the molten metal initially introduced into vessel 38 and can enable relatively rapid formation of plug 46 compared to lesser amounts of shot or no shot.

The start-up procedure described above was in the context of vessel 38 and a plug 46 formed as a result of the chilling effect produced by the movement of strip 32 through the strip passage opening and into the upstream end of vessel narrow part 58. The same start-up procedure can be performed when one employs vessel 138 and chilling element 139.

As previously indicated, it is desireable to maintain the temperature of bath 40 above the melting point of the coating metal (420° C. (788° F.) in the case of zinc) up to about 500° C. (932° F.), e.g. a temperature in the range 435–470° C. (815–878° F.), and to maintain the bath at a relatively stable temperature within these ranges. This can be accomplished, in one embodiment, by locating thermocouples at the positions indicated in FIG. 27 (FIG. 27 is on sheet 14). A series of thermocouples 230–232 are located on chilling element 139. The series of thermocouples 230–232 preferably should be located at the mid-point 229 of the longitudinal dimension of chilling element 139 (see FIG. 17), along a vertical inner surface 136 of a chilling element half 144 (FIG. 27).

Figure 17:
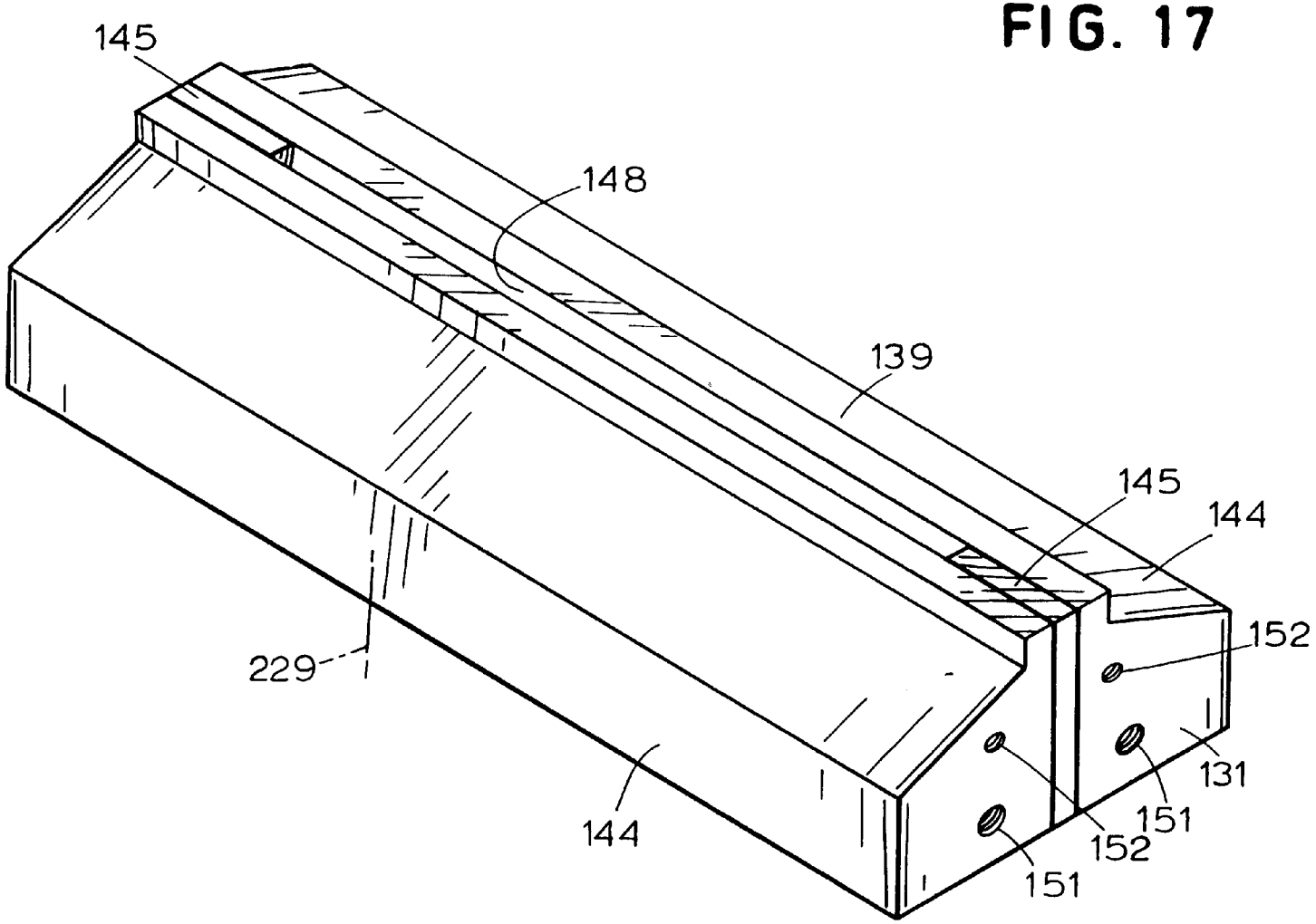
FIG. 17 is a perspective of a chill element used in the embodiment of the system illustrated in FIGS. 3–5.

For example, assuming the chilling element has a longitudinal dimension of 16 inches (406 mm), the series of thermocouples 230–232 would be located 8 inches (203 mm) from an end of the chilling element (e.g., end 131 in FIG. 17). Referring to FIG. 27, one thermocouple 230 is located at or near the bottom of vertical inner surface 136, another thermocouple 231 is located at about the mid-point of the vertical dimension of vertical surface 136, and a third thermocouple 232 is located near the top of vertical surface 136. Assuming that the chilling element which is described two sentences above has a vertical dimension of 3 inches (76 mm), mid-level thermocouple 231 would be located about 1½ inches (38 mm) from the bottom of vertical surface 136, and upper thermocouple 232 would be located about ½ inch (12 mm) below the top of vertical surface 136.

A similar group of thermocouples, having vertical spacings essentially identical to those of thermocouples 230–232, may be positioned on vertical surface 136 about half-way between end 131 and mid-point 229 of chilling element 139 (FIG. 17).

In addition to the group of thermocouples 230–232, another thermocouple 233 (FIG. 27) is placed on the inner surface of converging sidewall 161 of vessel 138, at the lower end of the sidewall, and thermocouple 233 is aligned in a vertical plane with thermocouples 230–232. A further thermocouple may be located at the inner surface of converging sidewall 161, at the same vertical level as thermocouple 233, and aligned in a vertical plane with the group of thermocouples described in the preceding paragraph. Thermocouple 233 measures the temperature of the bath at bath location 147 (FIG. 19).

Thermocouples 230–233 are used to help control the temperature of bath 40 and the size (length) of plug 146, in the manner described below, with reference to FIGS. 4–5, 18–20 and 27. The temperature within bath 40 is monitored at thermocouple 233 in bath location 147 (FIGS. 19 and 27). As noted above, it may be desireable to maintain the temperature of bath 40 within the temperature range of 435–470° C. (815–878° F.), for example; and the bath temperature controls will be discussed in that context. One may assume that, in this example, molten coating metal is introduced into vessel 138 at a temperature of about 480° C. (896° F.). When the temperature of bath 40 drops to 435° C. (815° F.), as measured at thermocouple 233, the heating element associated with vessel 138 is activated.

As previously noted, the heating element can be an electromagnet 150 (FIGS. 4–5), an induction heating element 177 or 187 (FIGS. 19 and **20–20*b*) or a resistance heating element (rods 175, 176) (FIG. 18). Each heating element is actuable between (a) an active heating condition in which heat is imparted to bath 40 and (b) an inactive heating condition in which heat is not imparted to bath 40. So long as the bath temperature is in the range 435–470° C. (815–878° F.), the heating element is maintained in its inactive condition. When the temperature of bath 40 drops to a level which requires actuation of the heating element (e.g., 435° C.), the heating element is turned on and is kept on until the temperature of bath 40, as determined by thermocouple 233**, reaches the upper level of the selected temperature range (e.g. 470° C.), at which time the heating element is turned off.

As discussed above, thermocouple 233 (FIG. 27) monitors the temperature of bath 40 at bath location 147, a location which is immediately downstream of plug 146. It is important to monitor the temperature at bath location 147 to make sure that the temperature there does not drop below the melting point of the molten coating metal (in the case of zinc, 420° C. (788° F.)). The lower level of the temperature range within which bath 40 is maintained should be high enough to prevent the temperature at location 147 from dropping to a temperature which approaches the melting point of the molten coating metal.

As previously indicated, cooling fluid is normally circulated through lower cooling channels 151, 151 in chilling element 139 continuously throughout the hot dip coating operation while upper cooling channels 152, 152 are normally in a standby status. Assuming that a required height (length) for plug 146 is 3 inches (76 mm), if the height of plug 146 is not maintained at that level or above, cooling fluid is circulated through upper cooling channels 152, 152 to increase the height of plug 146.

The height of plug 146 can be determined by monitoring thermocouples 230–232. The temperature sensed at lower thermocouple 230 is always below that sensed at mid-level thermocouple 231, and the temperature sensed at upper thermocouple 232 is always above the temperature sensed at mid-level thermocouple 231. For example, when the temperature sensed at mid-level thermocouple 231 is 250° C. (482° F.), the temperature sensed at lower thermocouple 230 can be 200° C. (392° F.), and the temperature sensed at upper thermocouple 232 can be 340° C. (644° F.). Similarly, when the temperature sensed at mid-level thermocouple 231 is 300° C. (572° F.), the temperature sensed at lower thermocouple 230 can be 250° C. (482° F.), and the temperature sensed at upper thermocouple 232 can be 390° C. (734° F.).

The following discussion assumes that it is desireable to maintain the temperature at mid-level thermocouple 231 in the range 250–300° C. (482–572° F.), and the manner in which one controls the circulation of cooling fluid through chilling element 139 will be discussed in that context. When the temperature at thermocouple 231 increases to the upper level of this temperature range (300° C.), chilling fluid is circulated through upper channels 152, 152 in chilling element 139. This will produce a rapid drop in the temperature sensed at thermocouple 231. When the temperature sensed at mid-level thermocouple 231 drops to the lower level of the desired temperature range (250° C.), circulation of cooling fluid through upper channels 152, 152 is stopped.

However, if the temperature sensed at upper thermocouple 232 approaches the melting point of the coating metal (420° C. (788° F.) for zinc), that is a signal that cooling fluid should be circulated through upper channels 152, 152, regardless of the temperature sensed at mid-level thermocouple 231.

Circulating cooling fluid through upper channels 152, 152 produces rapid chilling along the upper part of vertical surface 136 on chilling element 139, in turn producing a rapid increase in the height of plug 146. When circulation of cooling fluid through upper channels 152, 152 is ended, the height of plug 146 gradually decreases.

The foregoing discussion concerns the use of temperatures sensed at plug thermocouples 231 and 232 as indicia for determining when to circulate cooling fluid through upper channels 152, 152; that discussion also concerns the use of temperatures sensed at bath thermocouple 233 as an indicium for determining when to activate the heating element for bath 40. That discussion applies to normal, steady state operating conditions for the system. Notwithstanding any of the above, if plug 146 grabs strip 32, that action can be used as an indicium (a) to increase the heat supplied to bath 40 by the bath's heating element (e.g. magnet 150) and (b) to stop circulating cooling fluid through upper channels 152, 152, thereby reducing the length of plug 146 which in turn reduces the drag exerted on strip 31 by plug 146.

Generally, cooling fluid circulation through lower channels 151, 151 is continuous and uncurtailed. Under certain circumstances, the length of plug 146 may become excessive and cannot be decreased rapidly enough by the combination of (i) activation of the heating element and (ii) cessation of cooling fluid circulation through upper cooling channels 152, 152. Under those circumstances, cooling fluid circulation through lower channels 151, 151 may be curtailed or stopped entirely; this should help decrease the length of plug 146 more rapidly.

The thermocouple arrangement described above has been described in the context of vessel 138 and chilling element 139 wherein thermocouples 230–233 are employed to measure the temperature of bath 40 and of plug 146 in passageway 148. A similar arrangement may be employed with vessel 38 and its narrow, neck-like, upstream part 58 (FIG. 2). In this embodiment (FIG. 2), a thermocouple like 233 would be employed to measure the temperature of bath 40 in vessel 38, at bath location 47, and thermocouples like 230–232 would be employed to measure the temperature of plug 46 in narrow, upstream vessel part 58.

Continuous strip 32 is typically a flat, thin, planar element, e.g. a steel sheet. However, a strip having the configuration described in the preceding sentence is merely illustrative of one type of continuous strip with which the present invention may be practiced. Other strip configurations such as rods, bars, wires, tubes and shapes, may be employed so long as leakage of the molten coating metal from the hot dip coating bath can be prevented in a manner in accordance with the present invention, i.e., by utilizing a plug composed of solidified coating metal, together with the above-described expedients for chilling the coating metal downstream of the strip passage opening and for heating the molten coating metal downstream of the plug.

The present invention has been illustrated in the context of a strip passage opening underlying the vessel containing the molten metal coating bath. However, the present invention may also be employed in a system wherein (i) the strip passage opening is located in the sidewall of a vessel and (ii) the vessel contains a molten metal coating bath having a top surface located above the level of the strip passage opening.

The foregoing discussion has been directed primarily to a use of the present invention when the molten metal coating bath is zinc or zinc alloy. When the present invention is used with other coating metals (e.g., aluminum), some of the operating parameters may differ from those employed when the coating metal is zinc (e.g., bath temperature, strip speed and/or temperature, and plug temperature). However, appropriate operating parameters for such other coating metals can be determined empirically, and such determinations should be within the level of skill in the hot dip coating art, given the foregoing disclosure.

The foregoing detailed description has been given for clearness of understanding only and no unnecessary limitations should be understood therefrom, as modifications will be obvious to those skilled in the art.

We claim:

1. A method for coating a continuous flat metal strip with a layer of coating metal, said method comprising the steps of:

providing a vessel for containing a bath of molten coating metal;

containing a bath of molten coating metal in said vessel, said bath having a top surface;

providing a strip passage opening associated with said vessel, said opening being located below said top surface of the bath;

moving a continuous flat metal strip along a path which extends through said strip passage opening and through said bath;

coating said strip with a layer of said coating metal as the strip moves along said path;

forming, from said bath, a plug which is composed of solidified coating metal, which surrounds said strip at a location downstream of said opening and which is substantially stationary relative to said strip;

employing said plug to prevent the escape of molten coating metal from said bath through said opening while permitting said strip to move through said bath;

chilling the coating metal within said vessel downstream of said opening to form and maintain said plug, employing said strip to chill the coating metal;

and heating said molten metal bath at a location downstream of said plug by generating a time-varying magnetic field comprising a part which extends across said bath downstream of, and in contact with and adjacent to, said plug.

2. The method of claim 1 wherein:

said chilling step is performed at a location downstream of, and in contact with and adjacent to, said opening to form said plug there.

3. The method of claim 1 wherein said chilling step further comprises:

controlling a chilling effect produced by the movement of said strip through said bath.

4. The method of claim 3 wherein said method comprises controlling the speed at which said strip moves through said bath and said step of controlling said chilling effect comprises:

providing said strip at a temperature substantially below the melting point of said coating metal as said strip enters said strip passage opening in the vessel.

5. The method of claim 4 wherein:

said step of controlling the chilling effect comprises controlling the strip temperature at which said strip enters said strip passage opening.

6. The method of claim 5 wherein:

said step of controlling the speed of said strip comprises maintaining said strip speed substantially unchanged.

7. The method of claim 4 wherein:

said method comprises applying a flux to the surface of said strip before the strip enters said strip passage opening;

said strip is maintained at an elevated temperature below the temperature at which said flux will dissociate during the period between (a) the time when said flux is applied and (b) the time said strip enters said bath;

and said strip enters said strip passage opening at a temperature sufficiently below the melting point of said coating metal to enable said strip to perform said chilling step so as to form and maintain said plug.

8. The method of claim 7 wherein:

said coating metal consists essentially of zinc;

said bath has a temperature greater than 420° C. (788° F.) as said strip enters said strip passage opening;

and said strip is provided with a temperature above 38° C. (100° F.) and below 120° C. (248° F.) as the strip enters said strip passage opening.

9. The method of claim 3 and comprising:

controlling the heating effect produced by said heating step so that the quantity of heat introduced into said bath by the heating step compensates for the quantity of heat removed from said bath by said chilling step.

10. The method of claim 9 and comprising:

balancing the chilling effect of said chilling step and the heating effect of said heating step to maintain the temperature of said bath substantially stable.

11. The method of claim 10 wherein:

said balancing step maintains said plug in a solid state and controls the length of said plug.

12. The method of claim 9 or 10 wherein:

said step of controlling said heating effect comprises controlling the temperature of said bath and performing said bath temperature-controlling step at a location downstream of, and in contact with and adjacent to, said plug.

13. The method of claim 1 and comprising:

employing gate means, located upstream of, and in contact with and adjacent to, said opening, for closing said opening to prevent the escape of molten metal from said bath through said opening, in the absence of said plug, while permitting said strip to move through said bath;

and mounting said gate means for movement between (i) a closed position for preventing the escape of molten metal from said bath through said opening and (ii) an open position displaced from said closed position.

14. The method of claim 13 and comprising:

employing, as said gate means, a pair of gates each located on a respective opposite side of said strip at said opening;

and employing wiper means on each of said gates for sealingly engaging a respective opposite side of said strip as the strip moves in a downstream direction, to help prevent said escape of molten metal.

15. The method of claim 1 wherein:

said vessel has (i) a relatively narrow part extending downstream from said opening and (ii) a relatively wide part located downstream of said narrow part;

said plug extends from said opening into said narrow part;

and said heating step is performed at a location downstream of, and in contact with and adjacent to, said plug.

16. The method of claim 1 wherein (a) there is a preselected bath temperature range for coating said strip, (b) said heating step has (i) an active stage in which heat is imparted to said bath and (ii) an inactive stage in which heat is not imparted to said bath, and (c) said method comprises:

monitoring the temperature of said bath;

employing said active heating stage to heat said bath, when the bath temperature is at the lower end of said bath temperature range;

and employing said inactive stage when the bath temperature is at the upper end of said bath temperature range.

17. The method of claim 1 wherein:

said moving step comprises moving said strip through said plug;

said plug exerts friction on said strip as the strip moves through the plug;

and said method comprises employing said heating step to reduce the length of said plug and thereby reduce the friction exerted on said strip by said plug.

18. The method of claim 1 wherein:

said vessel has (i) a relatively narrow part extending downstream from said opening and (ii) a relatively wide part located downstream of said narrow part;

said plug extends from said opening into said narrow part;

and said method comprises generating a magnetic field having a part which extends across said bath at a location downstream of, and in contact with and adjacent to, said plug.

19. The method of claim 18 wherein:

said step of generating said magnetic field comprises generating an electromagnetic field that induces an eddy current in said bath that cooperates with said field to exert a force, downstream of, and in contact with and adjacent to, said plug, that urges said molten metal bath in a direction having a component extending away from said opening.

20. The method of claim 18 and comprising:

employing a time-varying current to generate said magnetic field;

employing said magnetic field to agitate said bath;

and adjusting the amperage of said time-varying current to control the agitation produced by said magnetic field and avoid back and forth agitation, thereby to reduce erosion of said plug by said agitation.

21. The method of claim 1 wherein:

said step of moving said strip along said path comprises moving said strip along a substantially vertical path extending through said opening and through said bath.

22. The method of claim 1 and comprising:

controlling the length of said plug in a downstream direction from said opening.

23. The method of claim 22 wherein said length controlling step comprises:

providing said plug with a length sufficient (a) to resist being pushed in an upstream direction by the pressure of the bath located downstream of said plug and (b) to resist a localized melt-through due to the heat of said bath;

and providing said plug with a length short enough to avoid excessive drag on said strip as the strip moves downstream through said plug.

24. The method of claim 22 wherein said length controlling step comprises:

controlling a chilling effect of said chilling step.

25. The method of claim 22 or 24 and comprising:

performing said heating step downstream of, and in contact with and adjacent to, said plug;

and controlling the heating effect of said heating step to maintain said bath at a substantially stable temperature.

26. The method of claim 22 wherein said step of controlling the length of said plug comprises at least one of the following sub-steps:

(a) controlling the chilling effect of said chilling step;

(b) controlling the heating effect of said heating step;

(c) employing a combination of sub-steps (a) and (b).

27. The method of claim 26 and comprising:

maintaining the speed of said strip substantially unchanged.

28. A method as recited in claim 1 wherein said coating metal comprises one of the following: zinc, aluminum and alloys of each.

29. A start-up procedure for use with the method of claim 1, said start-up procedure comprising the steps of:

providing said vessel initially in an empty condition, without said bath;

locating closeable gate means downstream of, and in contact with and adjacent to, said strip passage opening for closing said opening to prevent the escape of coating metal from said bath through said opening, in the absence of said plug, while permitting said strip to move through said opening and through said bath;

closing said gate means;

introducing molten coating metal into said vessel;

moving said continuous metal strip along its path as the molten coating metal is introduced into said vessel;

chilling the molten coating metal introduced into said vessel, at a location downstream of said opening, to form said plug;

and then opening said gate.

30. A start-up procedure as recited in claim 29 and comprising:

initially not heating that part of said bath downstream of the location where said plug is formed;

and then, once said plug has formed, heating that part of the bath which is at a location downstream of, and in contact with and adjacent to, said plug.

31. A start-up procedure as recited in claim 29 and comprising:

placing pieces of cold metal shot, composed of said coating metal, at a location downstream of, and in contact with and adjacent to, said opening, prior to introducing said molten coating metal into said vessel, to enhance the chilling of the initial molten coating metal there.

32. A start-up procedure as recited in any of claims 29 to 31 and comprising:

performing said chilling step at a location downstream of, and in contact with and adjacent to, said opening to chill that part of the bath there and form the plug there.

* * * * *